US008190049B2

(12) United States Patent
Tanaka

(10) Patent No.: US 8,190,049 B2
(45) Date of Patent: May 29, 2012

(54) IMAGE FORMING APPARATUS CAPABLE OF DISCHARGING STACKED SHEETS

(75) Inventor: Kenji Tanaka, Kitakatsuragi-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 422 days.

(21) Appl. No.: 12/314,038

(22) Filed: Dec. 3, 2008

(65) Prior Publication Data

US 2009/0142091 A1 Jun. 4, 2009

(30) Foreign Application Priority Data

Dec. 4, 2007 (JP) ..... 2007-314008

(51) Int. Cl.
*G03G 15/00* (2006.01)

(52) U.S. Cl. ..... 399/82; 399/401; 399/402; 399/405; 399/407

(58) Field of Classification Search ..... 399/401, 399/407

See application file for complete search history.

(56) References Cited

U.S. PATENT DOCUMENTS

| | | | | |
|---|---|---|---|---|
| 2005/0084278 | A1 | 4/2005 | Kimura et al. | |
| 2005/0207811 | A1* | 9/2005 | Kimura et al. | 399/401 |
| 2006/0018695 | A1* | 1/2006 | Hirai | 399/407 |
| 2006/0198676 | A1 | 9/2006 | Kimura et al. | |
| 2007/0102861 | A1 | 5/2007 | Shida et al. | |

FOREIGN PATENT DOCUMENTS

| | | |
|---|---|---|
| JP | 2005-089024 | 4/2005 |
| JP | 2005-104599 | 4/2005 |
| JP | 2005-306607 | 11/2005 |
| JP | 2005-321482 | 11/2005 |
| JP | 2006-273454 | 10/2006 |
| JP | 2007-156406 | 6/2007 |
| JP | 2007-204239 | 8/2007 |

OTHER PUBLICATIONS

Notification of Reasons for Refusal—Appl. No. JP2007-314008 dated Nov. 25, 2009.*

* cited by examiner

*Primary Examiner* — David Gray
*Assistant Examiner* — David Bolduc
(74) *Attorney, Agent, or Firm* — Edwards Wildman Palmer LLP; David G. Conlin; David A. Tucker

(57) ABSTRACT

An image forming apparatus performs a single-side image formation such that, when a delay is needed, a stacked sheet discharge control section controls a sheet carrying mechanism so that: a first sheet (for a second imaging job) to be discharged after passing a first sheet-discharging roller via a first sheet-carrying path is directed to another carrying path without being discharged, and is stood by therein. The first sheet and a second sheet (for the second imaging job) which is carried to the first sheet-discharging roller via the first sheet-carrying path after the first sheet, then are concurrently discharged overlappingly. This eliminates needs for delaying image formation for the second imaging job, and for securing time for post-process for the first imaging job. Even if a delay is inevitable, this reduces the delay time greatly and improves the productivity of the image forming apparatus, without reducing its performance wastefully.

3 Claims, 16 Drawing Sheets

IMAGE FORMING APPARATUS CAPABLE OF DISCHARGING STACKED SHEETS

This Nonprovisional application claims priority under U.S.C. §119(a) on Patent Application No. 314008/2007 filed in Japan on Dec. 4, 2007, the entire contents of which are hereby incorporated by reference.

FIELD OF THE INVENTION

The present invention relates to a technique for improving productivity of an image forming system realized by adding a post-processing device to an image forming apparatus.

BACKGROUND OF THE INVENTION

Some image forming apparatuses are connectable to, as an option, a post-processing device which performs a post-process on a sheet discharged from the image forming apparatuses. An image forming apparatus provided with a post-processing device constitutes an image forming system. Examples of the post-process encompass: stapling sheets; discharging a sheet to a designated sheet output tray out of a plurality of sheet output trays; and offsetting a sheet discharging position on a sheet output tray.

Patent Document 1 (Japanese Unexamined Patent Application Publication, Tokukai, No. 2005-321482 (published on Nov. 17, 2005)) discloses such an image forming system which has the following arrangement: (i) before a post-processing device completes preparation for a change in a post-process, an image forming apparatus starts the second image forming job; and (ii) immediately after the post-processing device completes the preparation for the change in the post-process, the post-processing device starts the post-process for the second image forming job.

That is, the image forming apparatus stops carrying a sheet upon completion of the first image forming job (followed by the second image forming job). After that, at an appropriate timing before completion of the preparation for the change in the post-process, the image forming apparatus starts feeding and carrying the sheet again. Then, almost at the same point as the completion of the preparation for the change in the post-process, the image forming apparatus supplies the sheet to the post-processing device.

This reduces time between (i) start of the first image forming job and (ii) completion of a post-process for the second image forming job, compared with that of a conventional apparatus.

The arrangement in Patent Document 1 can prevent such a problem that the image forming apparatus is kept in a stand-by state throughout the time when the post-processing device is preparing for a change in a post-process. The arrangement in Patent Document 1, however, does not solve the following problem: in a case where image forming jobs are performed in succession, job efficiency is decreased because the image forming apparatus delays starting the second image forming job and causes the second image forming job to be in a stand-by state so that time required to perform a post-process for the first image forming job is secured.

SUMMARY OF THE INVENTION

An object of the present invention is to provide an image forming apparatus which improves its productivity and does not reduce its performance wastefully even in a case where (i) the image forming apparatus and a post-processing device constitute an image forming system and (ii) image forming jobs are performed in succession. In the image forming apparatus of the present invention, in a case where image forming jobs are performed in succession, (i) it is not necessary to delay an image formation to be performed for the second image forming job so that time required to perform a post-process for the first image forming job followed by the second image forming job is secured; or (ii) if the delay is inevitable, the delay time is reduced as much as possible.

In order to attain the foregoing object, a first image forming apparatus according to the present invention includes: (A) a sheet feeding section in which a sheet is stored; (B) an image forming section for forming an image on the sheet; (C) a first discharging section for discharging, to outside of the apparatus, the sheet on which the image is formed; (D) a main carrying path for directing the sheet from the sheet feeding section to the first discharging section through the image forming section; and (E) a first sub-carrying path for directing the sheet on which one side an image is formed, from an upstream side of the first discharging section in the main carrying path to an upstream side of the image forming section, (i) said image forming apparatus and (ii) a post-processing device, to be added to the image forming apparatus, for performing a post-process with respect to a sheet discharged from the first discharging section, constituting an image forming system, said image forming apparatus, further including: (F) a wait-time occurrence judgment section for judging whether or not it is necessary to delay an image formation to be processed for a second image forming job so that time required to perform a post-process for a first image forming job followed by the second image forming job is secured; (G) a single-side image formation judgment section for judging whether or not the second image forming job is for a single-side image formation in which an image is formed only on one side of a sheet; and (H) a stacked sheet discharge control section for controlling, when the wait-time occurrence judgment section judges it to be necessary to delay the image formation and the single-side image formation judgment section judges the second image forming job to be for the single-side image formation, a sheet carrying mechanism in the main carrying path and the first sub-carrying path so that (i) a first sheet for the second image forming job which first sheet is fed to the first discharging section through the main carrying path is directed from the first discharging section to the first sub-carrying path so as to be in a stand-by state, and (ii) the first sheet which is in the stand-by state and a second sheet for the second image forming job which second sheet is fed to the first discharging section through the main carrying path are concurrently and overlappedly discharged.

According to this, the wait-time occurrence judgment section judges whether or not it is necessary to delay the image formation to be processed for the second image forming job so that the time required to perform the post-process for the first image forming job followed by the second image forming job is secured. Further, the single-side image formation judgment section judges whether or not the second image forming job is for the single-side image formation in which the image is formed only on one side of the sheet.

Then, when the wait-time occurrence judgment section judges it to be necessary to delay the image formation and the single-side image formation judgment section judges the second image forming job to be for the single-side image formation, the stacked sheet discharge control section controls the sheet carrying mechanism in the main carrying path and the first sub-carrying path so that (i) the first sheet for the second image forming job which first sheet is fed to the first discharging section through the main carrying path is directed from the first discharging section to the first sub-carrying path so as to be in the stand-by state, and (ii) the first sheet which is in the stand-by state and the second sheet for the second image forming job which second sheet is fed to the first discharging section through the main carrying path are concurrently and overlappedly discharged.

Discharging the two sheets concurrently delays, for time taken for processing one sheet, a timing for discharging, to the post-processing device, the first sheet for the second image forming job. Therefore, it is possible to perform the post-process for the first image forming job by utilizing the delay time gained by the delay of the first sheet for the second image forming job.

That is, if time required to perform a post-process for the first image forming job is within the delay time gained by the delay of the first sheet for the second image forming job, it is possible to perform the second image forming job subsequently after the first image forming job, without stopping the image formation to be performed for the second image forming job. Further, even if the time required to perform the post-process for the first image forming job exceeds the delay time gained by the delay of the first sheet for the second image forming job, it is possible to reduce time in which the image formation to be performed for the second image forming job is stopped.

Thus, constituting an image forming system by using an image forming apparatus according to the present invention makes it possible to realize an image forming system which has a high productivity and does not reduce performance of an image forming apparatus wastefully.

In order to attain the foregoing object, a second image forming apparatus according to the present invention includes: (A) a sheet feeding section in which a sheet is stored; (B) an image forming section for forming an image on the sheet; (C) a first discharging section for discharging, to outside of the apparatus, the sheet on which the image is formed; (D) a main carrying path for directing the sheet from the sheet feeding section to the first discharging section through the image forming section; (E) a first sub-carrying path for directing the sheet on which one side an image is formed, from an upstream side of the first discharging section in the main carrying path to an upstream side of the image forming section; and (F) a second sub-carrying path for directing the sheet from the upstream side of the first discharging section in the main carrying path to a second discharging section, (i) said image forming apparatus and (ii) a post-processing device, to be added to the image forming apparatus, for performing a post-process with respect to a sheet discharged from the first discharging section, constituting an image forming system, said image forming apparatus, further including: (G) a wait-time occurrence judgment section for judging whether or not it is necessary to delay an image formation to be processed for a second image forming job so that time required to perform a post-process for a first image forming job followed by the second image forming job is secured; (H) a single-side image formation judgment section for judging whether or not the second image forming job is for a single-side image formation in which an image is formed only on one side of a sheet; and (I) a stacked sheet discharge control section for controlling, when the wait-time occurrence judgment section judges it to be necessary to delay the image formation and the single-side image formation judgment section judges the second image forming job to be for the single-side image formation, a sheet carrying mechanism in the main carrying path, the first sub-carrying path, and the second sub-carrying path so that (i) a first sheet for the second image forming job which first sheet is fed to the first discharging section through the main carrying path is directed from the first discharging section to one of the first and second sub-carrying paths so as to be in a stand-by state, (ii) a second sheet for the second image forming job which second sheet is fed to the first discharging section through the main carrying path is directed from the first discharging section to the other of the first and second sub-carrying paths so as to be in a stand-by state, and (iii) the first sheet and the second sheet which are in the stand-by state and a third sheet for the second image forming job which third sheet is fed to the first discharging section through the main carrying path are concurrently and overlappedly discharged.

According to this, the wait-time occurrence judgment section judges whether or not it is necessary to delay the image formation to be processed for the second image forming job so that the time required to perform the post-process for the first image forming job followed by the second image forming job is secured. Further, the single-side image formation judgment section judges whether or not the second image forming job is for the single-side image formation in which the image is formed only on one side of the sheet.

Then, when the wait-time occurrence judgment section judges it to be necessary to delay the image formation and the single-side image formation judgment section judges the second image forming job to be for the single-side image formation, the stacked sheet discharge control section functions so that (i) the first sheet for the second image forming job which first sheet is fed to the first discharging section through the main carrying path is directed from the first discharging section to one of the first and second sub-carrying paths so as to be in the stand-by state, (ii) the second sheet for the second image forming job which second sheet is fed to the first discharging section through the main carrying path is directed from the first discharging section to the other of the first and second sub-carrying paths so as to be in the stand-by state, and (iii) the first sheet and the second sheet which are in the stand-by state and the third sheet for the second image forming job which third sheet is fed to the first discharging section through the main carrying path are concurrently and overlappedly discharged.

Discharging the three sheets concurrently delays, for time taken for processing two sheets, a timing for discharging, to the post-processing device, the first sheet for the second image forming job. Therefore, it is possible to perform the post-process for the first image forming job by utilizing the delay time gained by the delay of the first sheet for the second image forming job.

That is, if time required to perform a post-process for the first image forming job is within the delay time gained by the delay of the first image forming job, it is possible to perform the second image forming job subsequently after the first image forming job, without stopping the image formation to be performed for the second image forming job. Further, even if the time required to perform the post-process for the first image forming job exceeds the delay time gained by the delay of the first sheet for the second image forming job, it is possible to reduce time in which the image formation to be performed for the second image forming job is stopped.

Thus, constituting an image forming system by using an image forming apparatus according to the present invention makes it possible to realize an image forming system which has a high productivity and does not reduce performance of an image forming apparatus wastefully.

Additional objects, features, and strengths of the present invention will be made clear by the description below. Further, the advantages of the present invention will be evident from the following explanation in reference to the drawings.

DESCRIPTION OF THE EMBODIMENTS

Figure 1:
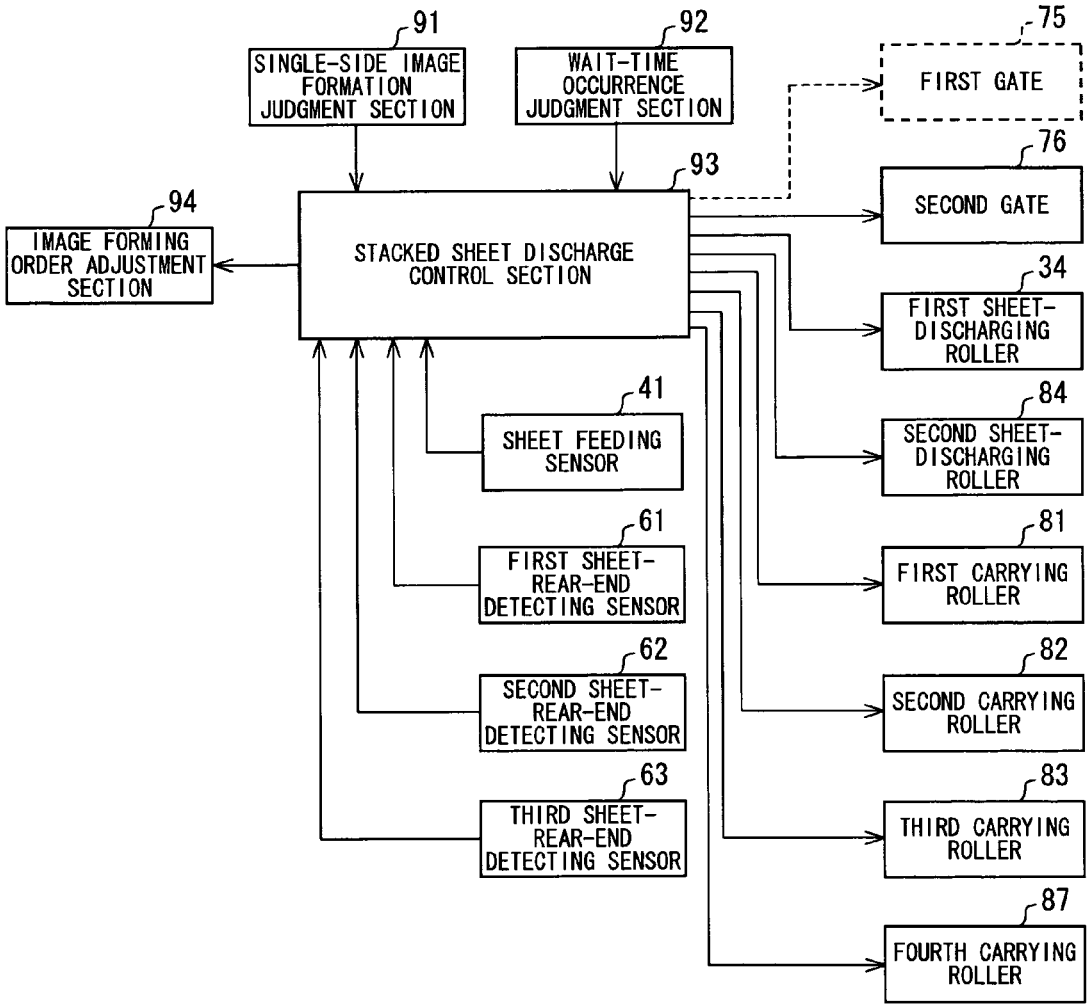
FIG. 1 illustrates one embodiment of the present invention, and is a functional block diagram for realizing double-stacked sheet discharge and triple-stacked sheet discharge in an image forming system.

The following describes, with reference to FIG. 1 through FIG. 16, one embodiment of the present invention. Firstly, an arrangement of an image forming system 1 according to one embodiment of the present invention is described with reference to FIG. 2. FIG. 2 is an explanatory view illustrating the arrangement of the image forming system 1.

The image forming system 1 is constituted by adding, to an image forming apparatus 2, (i) a post-processing device 3 and (ii) two sheet feeding devices 4 and 5. The description herein deals with, as an example, the image forming apparatus 2 provided with (i) the post-processing device 3 and (ii) the two sheet feeding devices 4 and 5. However, an image forming system according to the present invention only needs to be provided with at least an image forming device and a post-processing device provided to the image forming device.

The image forming apparatus 2 forms an image in multi colors or in a mono color selectively by means of an electrophotographic printing method, in accordance with image information inputted via a network or the like. Then, the image forming apparatus 2 records, on a sheet, the image thus formed. The image forming apparatus 2 includes an image forming section 6, a sheet storing section 7, and a sheet carrying section 8.

The image forming section 6 includes an exposure unit 10, an intermediate transfer belt 11, and a second transfer roller 14. There are image forming stations 12A to 12D between the intermediate transfer belt 11 and the exposure unit 10. The image forming stations 12A to 12D are provided in a row.

The image forming stations 12A to 12D form images in accordance with image information of four colors, respectively. The four colors include black, cyan, magenta, and yellow. Of the four colors, cyan, magenta, and yellow are the three primary colors of subtractive color mixture. The three primary colors are obtained by separating colors in a colored image.

The image forming station 12A for black includes a photoreceptor drum 101A, a developing unit 102A, a charging roller 103, a first transfer roller 104, a cleaning unit 105, and the like.

The charging roller 103 is a contact-type charging device for uniformly charging a surface of the photoreceptor drum 101A at a predetermined electric potential. Instead of the charging roller 103, the followings may also be used: a contact-type charging device using a charging brush; or a non-contact type charging device using an electrifying charger. The exposure unit 10 includes: a light source such as a semiconductor laser; a polygon mirror; a reflection mirror; and the like. The exposure unit 10 irradiates, onto the photoreceptor drum 101A, image light in accordance with black image information. Then, on the photoreceptor drum 101A, an electrostatic latent image corresponding to the back image information is formed.

The developing unit 102A supplies black toner on the surface (on which the electrostatic latent image is formed) of the photoreceptor drum 101A, and develops the electrostatic latent image into a toner image. The cleaning unit 104 collects toner remaining on the surface of the photoreceptor drum 101A.

The intermediate transfer belt 11 forms an operation path having a loop-shape. In the lower part of the operation path, the intermediate transfer belt 11 passes through between the photoreceptor drum 101A and the first transfer roller 104.

The first transfer bias of a polarity reverse to a charging polarity of toner is applied to the first transfer roller 104 by means of constant voltage control. Then, the toner image formed on the photoreceptor drum 101A is transferred onto an outer surface of the intermediate transfer belt 11.

The image forming station 12B for cyan, the image forming station 12C for magenta, and the image forming station 12D for yellow have a similar arrangement to that of the image forming station 12A. Image light is modulated in accordance with cyan image information, magenta image information, and yellow image information, respectively. Then, the image light thus modulated is irradiated to the image forming stations 12B, 12C, and 12D by the exposure unit 10, respectively. Also, the developing units 102B, 102C, and 102D supply cyan toner, magenta toner, and yellow toner to the photoreceptor drums 101B, 101C, and 101D, respectively.

Thus, the photoreceptor drums 101B, 101C, and 101D have a cyan toner image, a magenta toner image, and a yellow toner image on their surfaces, respectively.

There is a case that image information of only a part of the colors (yellow, magenta, cyan, and black) is inputted. In such a case, the formation of an electrostatic latent image and a toner image is performed by, out of the four image forming stations 12A, 12B, 12C, and 12D, an image forming station(s) corresponding to the part of the colors. For example, in a case that a monochrome image is formed, only the image forming station 12A for black forms an electrostatic latent image and a toner image. Then, the image formed only by a black developer is transferred onto the outer surface of the intermediate transfer belt 11.

In a case that a full-color image is formed, all of the four image forming stations 12A, 12B, 12C, and 12D form electrostatic latent images and toner images, respectively. Then, a yellow toner image, a magenta toner image, a cyan toner image, and a black toner image are subsequently transferred onto the outer surface of the intermediate transfer belt 11, so that these toner images are layered.

In the present invention, the transfer of a toner image onto the outer surface of the intermediate transfer belt 11 corresponds to preparation for an image performed by the image forming section 6.

The toner image thus transferred onto the outer surface of the intermediate transfer belt 11 is carried, by means of rotation of the intermediate transfer belt 11, to a position where the intermediate transfer belt 11 faces the second transfer roller 14. The second transfer roller 14 touches and presses, at a predetermined nip pressure, the outer surface of the intermediate transfer belt 11. The position where the intermediate transfer belt 11 faces the second transfer roller 14 is an image forming position 30 where an image is formed on a sheet.

The sheet storing section 7 includes (i) sheet feeding cassettes 16A and 16B in each of which a plurality of sheets of a certain type are stored and (ii) a manual sheet feeding tray 17. Further, the image forming apparatus 2 is provided with, as an option, the sheet feeding devices 4 and 5 each of which is used as an external sheet storing section.

The sheet feeding device 4 is provided in the lower part of the image forming apparatus 2, and internally includes sheet feeding cassettes 16C and 16D. The sheet feeding device 5 is provided beside the image forming apparatus 2. Further, the sheet feeding device 5 stores a large number of sheets of a certain type.

The sheet carrying section 8 includes a first sheet-carrying path 31. The first sheet-carrying path 31 extends from the sheet feeding cassettes 16A and 16B, via the image forming position 30, to the post-processing device 3 mounted on the top of the image forming apparatus 2. The first sheet-carrying path 31 is provided with pickup rollers 21A and 21B, sheet feeding rollers 22A and 22B, a registration roller 32, a fixing unit 33, a fourth carrying roller 87, a first sheet-discharging roller 34, and the like.

Further, the sheet carrying section 8 includes a second sheet-carrying path 35 for connecting the manual sheet feeding tray 17 to an upstream side (in a direction that the first sheet-carrying path 31 carries a sheet) of the registration roller 32.

Furthermore, the sheet carrying section 8 includes a third sheet-carrying path 36 (carrying path for duplex printing) and a fourth sheet-carrying path 39. The third sheet-carrying path 36 is for connecting (i) a path between the fixing unit 33 in the first sheet-carrying path 31 and the first sheet-discharging roller 34 to (ii) the upstream side (in the direction that the first sheet-carrying path 31 carries a sheet) of the registration roller 32. The fourth sheet-carrying path 39 is for connecting, via a second sheet-discharging roller 84, (i) the path between the fixing unit 33 in the first sheet-carrying path 31 and the first sheet-discharging roller 34 to (ii) a right sheet output tray 72. The third sheet-carrying path 36 is used in duplex image forming, in which an image is formed on both sides of a sheet. In the duplex image forming, after an image is formed on one side of a sheet, the first sheet-discharging roller 34 rotates in the reverse direction so that the sheet is carried in a switchback manner. At this time, the sheet passes through the third sheet-carrying path 36.

Moreover, the sheet carrying section 8 includes a fifth sheet-carrying path 37 for connecting the sheet feeding device 5 to the first sheet-carrying path 31. The sheet feeding cassettes 16C and 16D included in the sheet feeding device 4 are connected to the first sheet-carrying path 31, via a sixth sheet-carrying path 38 provided in the sheet feeding device 4. An arrangement of the sheet carrying section 8 will be described in detail later with reference to FIG. 4.

A sheet supplied from the sheet storing section 7, the sheet feeding device 4, or the sheet feeding device 5 is carried through the first sheet-carrying path 31. When the sheet passes through the image forming position 30, a toner image is transferred from the intermediate transfer belt 11 onto one side of the sheet. After that, in a case of duplex image forming, the first sheet-discharging roller 34 rotates in the reverse direction, so that the sheet onto which the toner image has been thus transferred is carried in the switchback manner. Then, the sheet is carried through the third sheet-carrying path 36, and returns to the first sheet-carrying path 31. Subsequently, the sheet passes through the image forming position 30, so that another toner image is transferred from the intermediate transfer belt 11 onto another side of the sheet.

The registration roller 32 provided in the first sheet-carrying path 31 does not rotate at a point when a top end of the sheet carried from the sheet storing section 7 (the sheet feeding cassette 16A, the sheet feeding cassette 16B, and the manual sheet feeding tray 17), the sheet feeding device 4, the sheet feeding device 5, or the third sheet-carrying path 36 reaches the registration roller 32.

The registration roller 32 starts rotating at a timing that causes a top end of a toner image on the intermediate transfer belt 11 to reach the image forming position 30 when the top end of the sheet reaches the image forming position 30 after the sheet passes through the registration roller 32.

Thus, the sheet is carried through the first sheet-carrying path 31 by the registration roller 32 so that the top end of the sheet meets the top end of the toner image at the image forming position 30.

Further, the registration roller 32 has a function for correcting a direction of a sheet which is fed with an angle. With this function, if a sheet is fed with an angle, a top end of the sheet gets in touch with the registration roller 32 which does not rotate, and thereby the direction of the sheet is corrected.

At the image forming position 30, the toner image is transferred onto the sheet. Then, the sheet is carried to the fixing unit 33. The fixing unit 33 is provided with a heat roller 33A and a pressure roller 33B. The heat roller 33A is heated to a toner melting temperature, and the pressure roller 33B touches and presses the heat roller 33A at a predetermined nip pressure. When the sheet passes through the fixing unit 33, heat and pressure are applied to the sheet. Then, the sheet is discharged to the post-processing device 3, with the toner image fixed on the surface of the sheet.

At the image forming position 30, the whole of a toner image on the outer surface of the intermediate transfer belt 11 should be transferred onto a sheet. In some cases, however, a part of the toner image is not transferred and thereby remains on the intermediate transfer belt 11. Also, in some cases, a process described later causes a toner image on the outer surface of the intermediate transfer belt 11 to pass through the image forming position 30 without being transferred onto a sheet. In such cases, the toner remains on the intermediate transfer belt 11 even after the toner image passes through the image forming position 30. The toner which remains is collected by the cleaning unit 13.

The post-processing device 3 receives a sheet discharged through an optional process outlet 85 in the image forming apparatus 2, and carries the sheet to the inside of the post-processing device 3. Then, the post-processing device 3 performs various kinds of post-processes on the sheet, and places the sheet on the sheet output tray. Examples of the post-process encompass: stapling sheets; discharging a sheet to a designated sheet output tray out of a plurality of sheet output trays; and offsetting a sheet discharging position on a sheet output tray.

Figure 3:
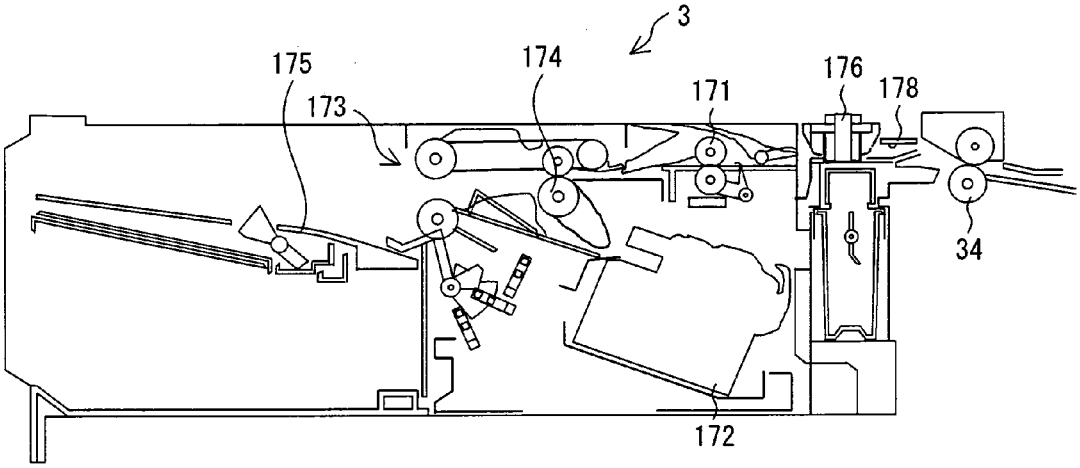
FIG. 3 is a view illustrating an arrangement of a post-processing device added to the image forming system.

FIG. 3 is an enlarged view of the post-processing device 3. In the present embodiment, it is possible to perform, as a post-process, a stapling process for stapling sheets and a punching process for punching a hole in a sheet.

The post-processing device 3 includes: an inlet roller 171; a stapler 172; a punch pin 178; an alignment processing section 173; a sheet discharging roller 174; a sheet-rear-end detecting sensor 176; a sheet output tray 175; and the like. After the first sheet-discharging roller 34 in the image forming apparatus 2 discharges a sheet, the sheet is carried to the alignment processing section 173 by the inlet roller 171. Then, the alignment processing section 173 loads the sheet sequentially on a processing table, and align the sheets. The alignment processing section 173 is provided with an alignment plate, a paddle, a collecting belt, and the like.

In the stapling process, the stapler 172 staples, at a designated position, a bundle of sheets which are aligned. The bundle of sheets thus stapled is discharged onto the sheet output tray 175 by the sheet discharging roller 174.

In the punching process, at a point when the sheet-rear-end detecting sensor 176 detects a rear end of a sheet, carrying of the sheet is temporarily stopped, and the punch pin 178 punches a hole in the rear end of the sheet. After that, the sheet thus punched is carried to the alignment processing section 173 and is aligned with another sheet. Then, the sheets are discharged onto the sheet output tray 175 by the sheet discharging roller 174.

Figure 4:
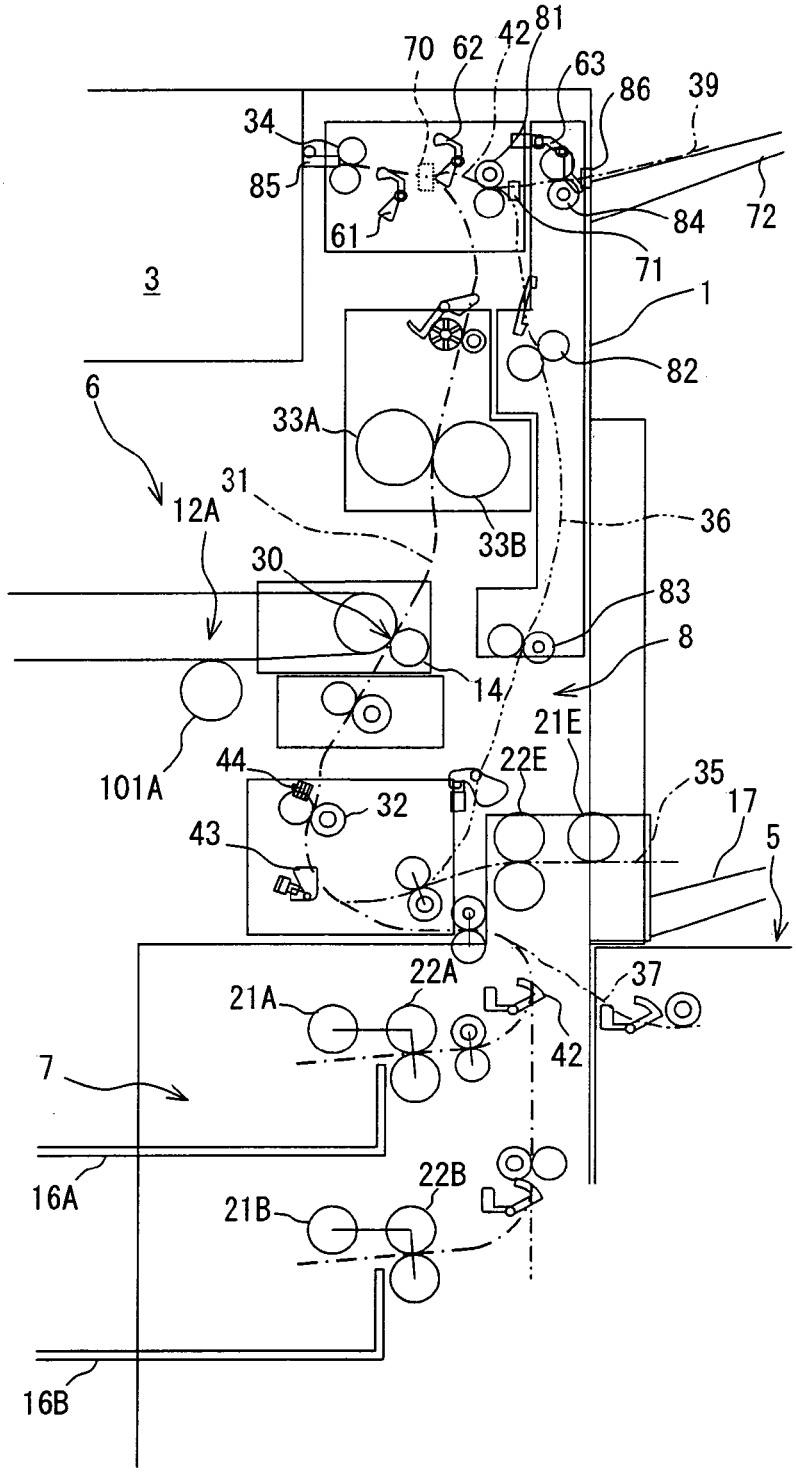
FIG. 4 is a view illustrating an arrangement of a carrying path of a sheet carrying section provided in an image forming apparatus in the image forming system.

FIG. 4 is a view illustrating an arrangement of main parts in the vicinity of: the first sheet-carrying path 31 in the sheet carrying section 8 included in the image forming apparatus 2; and the third sheet-carrying path 36 and the fourth sheet-carrying path 39, each of which diverges from the first sheet-carrying path 31.

As described above, the first sheet-carrying path 31 is provided in a space inside the image forming apparatus 2, the space extending from the sheet storing section 7 to the post-processing device 3, via the image forming position 30 in the image forming section 6. To the first sheet-carrying path 31, a sheet is supplied from sheet feeding cassettes which are included in the sheet storing section 7, the sheet feeding device 4, and the sheet feeding device 5. The sheet feeding cassettes are provided with sheet feeding sensors 41, respectively. The sheet feeding sensors 41 detect whether or not sheets are fed from the sheet feeding cassettes in the sheet storing section 7, the sheet feeding device 4, and the sheet feeding device 5, respectively.

Further, a registration sensor 44 is provided in the vicinity of the registration roller 32 in the first sheet-carrying path 31. The registration sensor 44 detects whether or not a top end of a sheet has reached a position where the registration roller 32 is provided.

The first sheet-discharging roller (first discharging section) 34, which is provided in the first sheet-carrying path 31, is arranged so as to be driven in the forward and reverse directions. When the first sheet-discharging roller 34 is driven in the forward direction, a sheet is carried to the post-processing device 3 through the optional process outlet 85. When the first sheet-discharging roller 34 is driven in the reverse direction while holding a rear end of a sheet, the sheet is carried in the switchback manner.

In the vicinity of the first sheet-discharging roller 34, a first sheet-rear-end detecting sensor 61 is provided. The first sheet-rear-end detecting sensor 61 detects whether or not a rear end of a sheet to be carried to the post-processing device 3 has reached the first sheet-discharging roller 34. In the present specification, the "rear end" and "front end" of a sheet are determined in accordance with a direction that the sheet is carried. Therefore, the "front end" and "rear end" reverse between before and after a sheet is carried in the switchback manner.

In the image forming system 1 of the present embodiment, the third sheet-carrying path 36 and the fourth sheet-carrying path 39, each of which diverges from the first sheet-carrying path 31, share a part of a path diverging from the first sheet-carrying path 31. A shared path 42 is provided with a first carrying roller 81. On the downstream side of the first carrying roller 81 (i.e., on the downstream side in accordance with a direction that a sheet is carried in the switchback manner), the third sheet-carrying path 36 and the fourth sheet-carrying path 39 diverge from each other.

The third sheet-carrying path 36 is further provided with a second carrying roller 82 and a third carrying roller 83. The fourth sheet-carrying path 39 is further provided with a second sheet-discharging roller (second discharging section) 84. In the image forming system 1 of the present embodiment, the first carrying roller 81, the second carrying roller 82, the third carrying roller 83, and the second sheet-discharging roller 84 are also arranged so as to be driven in the forward and reverse directions.

When the first carrying roller 81, the second carrying roller 82, and the third carrying roller 83 are driven in the forward direction, a sheet carried by the first sheet-discharging roller 34 in the switchback manner is carried through the third sheet-carrying path 36, and is returned to the registration roller 32. When the first carrying roller 81, the second carrying roller 82, and the third carrying roller 83 are driven in the reverse direction, a sheet carried into the third sheet-carrying path 36 is carried toward the first sheet-discharging roller 34 again.

When the first carrying roller 81 and the second sheet-discharging roller 84 are driven in the forward direction, a sheet carried by the first sheet-discharging roller 34 in the switchback manner is carried onto the right sheet output tray 72 via a right sheet outlet 86. When the first carrying roller 81 and the second sheet-discharging roller 84 are driven in the reverse direction, the sheet carried onto the right sheet discharging tray 72 is carried in the switchback manner, and then is carried toward the first sheet-discharging roller 34 again.

In the vicinity of the first carrying roller 81, a second sheet-rear-end detecting sensor 62 is provided. The second sheet-rear-end detecting sensor 62 detects whether or not a rear end of a sheet has reached the first carrying roller 81, the sheet being carried in the switchback manner by the first sheet-discharging roller 34 toward the third sheet-carrying path 36 or the fourth sheet-carrying path 39 through the shared path 42.

In the vicinity of the second sheet-discharging roller 84, a third sheet-rear-end detecting sensor 63 is provided. The third sheet-rear-end detecting sensor 63 detects whether or not a rear end of a sheet has reached the second sheet-discharging roller 84, the sheet being carried in the switchback manner by the first sheet-discharging roller 34 toward the right sheet output tray 72.

The shared path 42 of the third sheet-carrying path 36 and the fourth sheet-carrying path 39 diverges from the first sheet-carrying path 31 at a first diverging section 70. The first diverging section 70 is provided with a first gate 75 (see FIG. 5(*a*) to FIG. 5(*c*)) for switching, from one to another, a direction that a sheet is carried. Further, the third sheet-carrying path 36 and the fourth sheet-carrying path 39 diverge from the shared path 42 at a second diverging section 71. The second diverging section 71 is provided with a second gate 76 (see FIG. 6(*a*) to FIG. 6(*c*)) for switching, from one to another, the direction that a sheet is carried.

Figure 5:
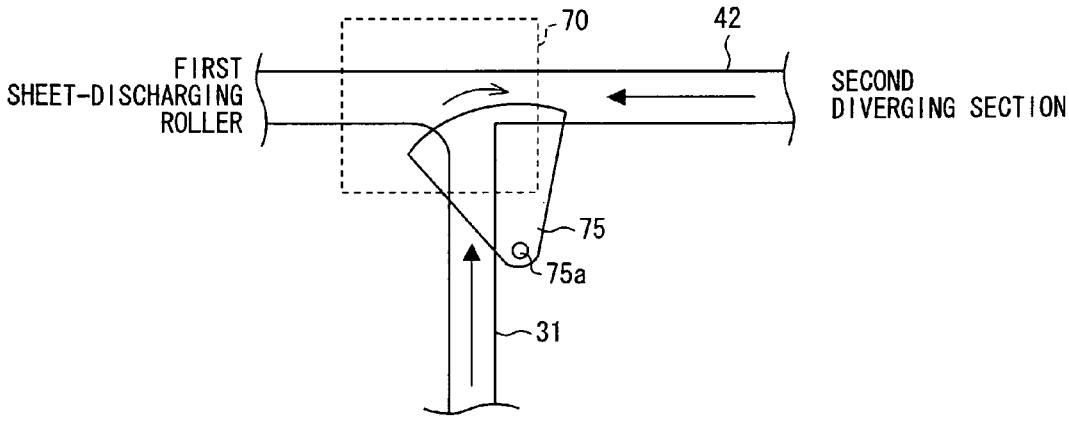
FIGS. 5(*a*) through 5(*c*) are explanatory views illustrating how a first gate operates, the first gate being provided at a first diverging section in the sheet carrying section provided in the image forming apparatus in the image forming system.
Figure 5:
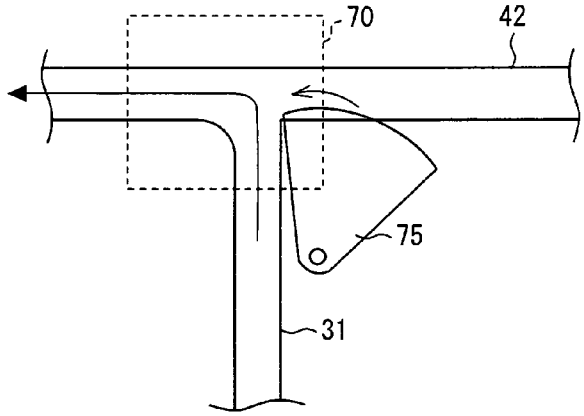
Figure 5:
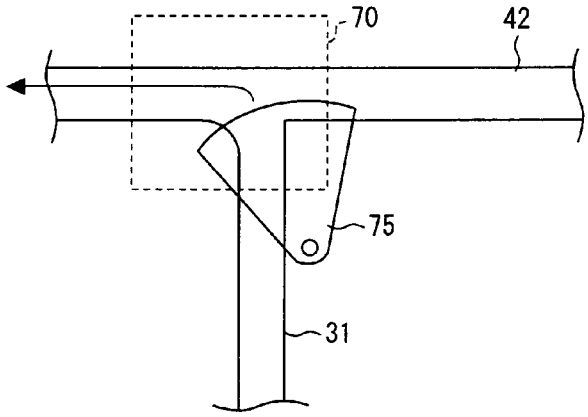

As illustrated in FIG. 5(*a*), the first gate 75 is a fan-shaped gate. Generally, the first gate 75 closes the first sheet-carrying path 31 while the first gate 75 is in a stand-by state. When a sheet carried upward through the first sheet-carrying path 31 touches and pushes the first gate 75, the first gate 75 rotates around a rotation axis 75*a* by using a force applied by the sheet. This leads to a state illustrated in FIG. 5(*b*). While the sheet is passing through the first gate 75, the state illustrated in FIG. 5(*b*) is maintained. At a point that the sheet has passed through the first gate 75, the first gate 75 rotates by using its own weight, thereby returning to its original position as illustrated in FIG. 5(*c*).

The first gate 75 is arranged so as not to interfere with carrying of a sheet from the shared path 42 toward the first diverging section 70 in both the states illustrated in FIG. 5(*a*) and FIG. 5(*b*).

In the arrangement described so far, the first gate 75 has the fan-shape, and rotates by using (i) elasticity of a sheet carried through the first sheet-carrying path 31 and (ii) a weight of the first gate 75. However, it is also possible to have such an arrangement that the first gate 75 is driven by means of a solenoid or the like.

Figure 6:
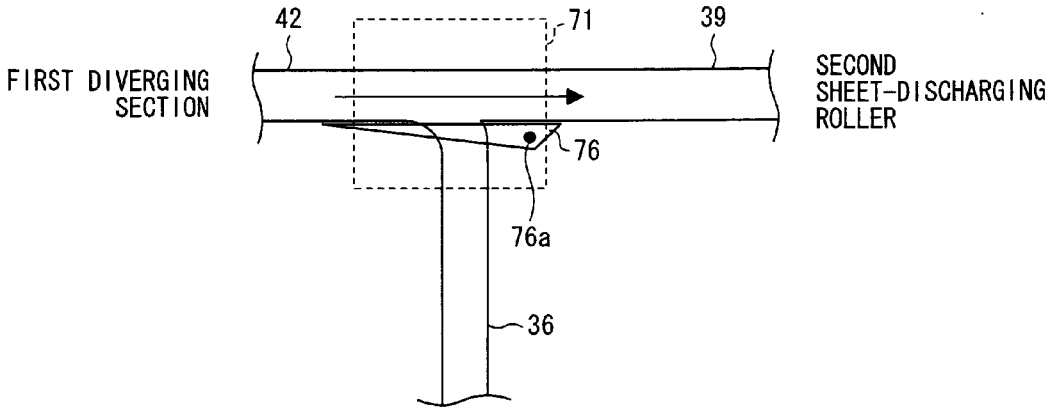
FIGS. 6(*a*) through 6(*c*) are explanatory views illustrating how a second gate operates, the second gate being provided at a second diverging section in the sheet carrying section provided in the image forming apparatus in the image forming system.
Figure 6:
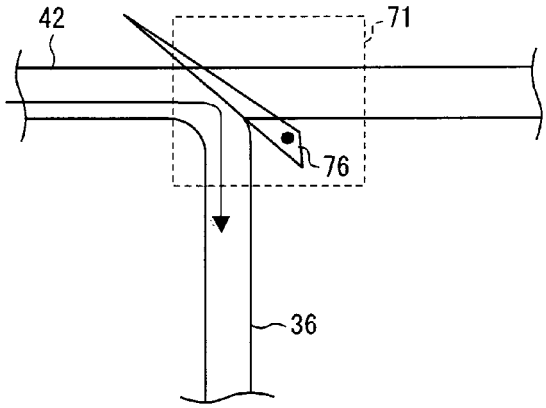
Figure 6:
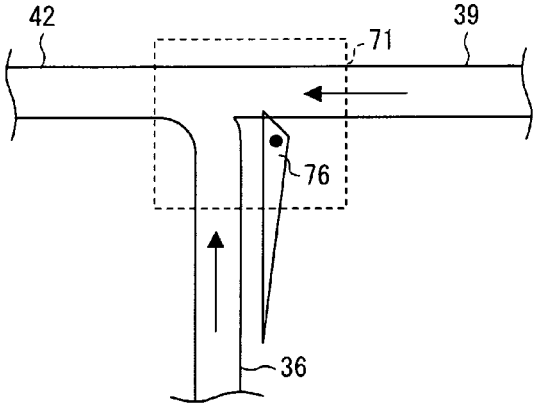

On the other hand, the second gate 76 rotates around a rotation axis 76*a*, and can be in three states illustrated in FIG. 6(*a*) to FIG. 6(*c*). FIG. 6(*a*) illustrates a state where a sheet carried from the shared path 42 toward the second diverging section 71 is directed to the fourth sheet-carrying path 39. FIG. 6(*b*) illustrates a state where a sheet carried from the shared path 42 toward the second diverging section 71 is directed to the third sheet-carrying path 36. FIG. 6(*c*) illustrates a state where (i) the second diverging section 71 is opened and (ii) sheets carried from the third sheet-carrying path 36 and the fourth sheet-carrying path 39 toward the second diverging section 71 are directed to the shared path 42. The second gate 76 is driven as described above by means of a solenoid or the like (not illustrated).

Figure 7:
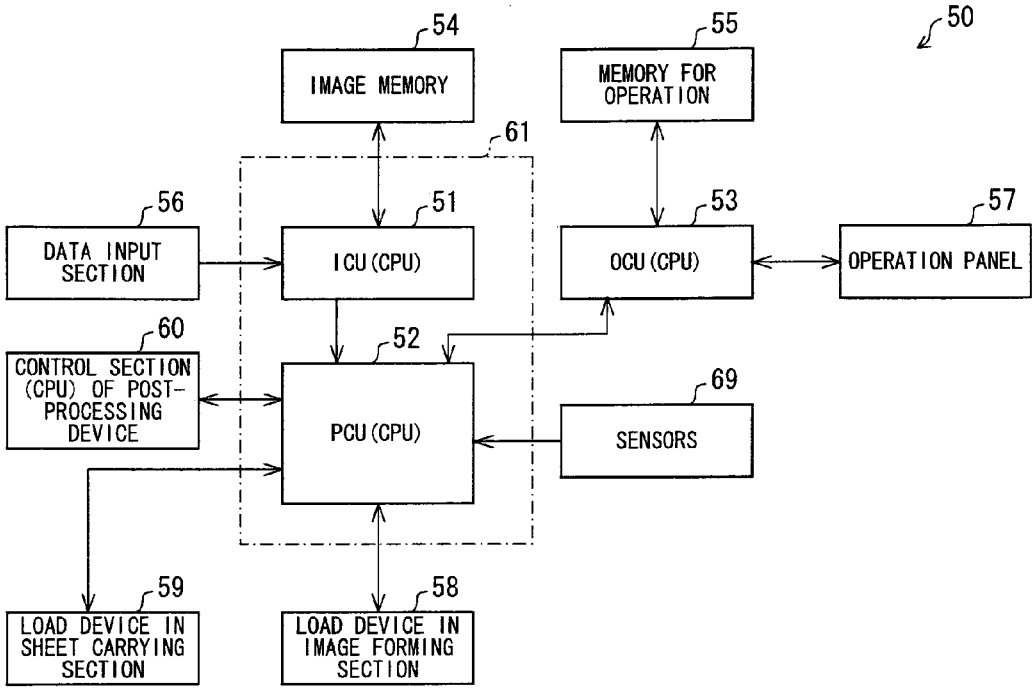
FIG. 7 is a block diagram illustrating an arrangement of a control section of the image forming apparatus in the image forming system.

Next, the following describes, with reference to FIG. 7, an arrangement of a control section 50 of the image forming apparatus 2. FIG. 7 is a block diagram illustrating the arrangement of the control section 50 of the image forming apparatus 2. The control section 50 of the image forming apparatus 2 includes: an image control unit (hereinafter, referred to as an ICU) 51; a process control unit (hereinafter, referred to as a PCU) 52; and an operation control unit (hereinafter, referred to as an OCU) 53.

The OCU 53 is provided with a memory 55 for operation, and is connected to an operation panel 57. The OCU 53 stores, in the memory 55 for operation, operation information inputted from the operation panel 57. Further, the OCU 53 supplies, to the ICU 51, information regarding an image process on image information among the operation information. Furthermore, the OCU 53 supplies, to the PCU 52, information regarding image formation among the operation information.

The ICU 51 is provided with an image memory 54, and is connected to a data input section 56. The ICU 51 performs, in accordance with the information inputted from the OCU 53, a predetermined image process on image information inputted from the outside via the data input section 56. Then, the ICU 51 stores, in the image memory 54, the image information thus processed.

The PCU 52 is connected to: load devices 58 and 59 (such as a motor or a clutch) provided in the image forming section 6 and the sheet carrying section 8, respectively; and the post-processing device 3. The PCU 52 transmits, to a control section 60 of the post-processing device 3, information regarding a post-process on a sheet. The information regarding a post-process includes: contents of a post-process; and in a case of stapling, a position at which sheets are stapled, the number of positions to be stapled, and the like.

The control section 60 of the post-processing device 3 transmits, to the PCU 52, information regarding time required to perform a post-process, in accordance with information regarding the post-process transmitted from the PCU 52. The time required to perform a post-process is determined depending on contents of the post-process. For example, time required to perform a stapling process is determined by: the number of positions to be stapled; whether or not a punching process is performed together with the stapling process; and the like.

The control section 60 of the post-processing device 3 includes a table in which a content of a post-process is linked to time taken for the post-process. The control section 60 transmits the time taken for the post-process to the PCU 52, in accordance with the table. Instead, it is possible to have such an arrangement that the PCU 52 includes a table similar to the foregoing table.

Further, to the PCU 52, a detection signal is inputted from various kinds of sensors 69 (such as the sheet feeding sensors 41, the registration sensor 44, the first sheet-rear-end detecting sensor 61, the second sheet-rear-end detecting sensor 62, and the third sheet-rear-end detecting sensor 63).

The PCU 52 drives the load devices 58 and 59 as described later, in accordance with: a detection signal from the various kinds of the sensors 69; operation information inputted from the OCU 53; and information regarding time required to perform a post-process, the information being inputted from the control section 60 of the post-processing device 3.

Next, the following describes stacked sheet discharge, which is a remarkable arrangement in the image forming system 1. The stacked sheet discharge is a sheet discharge mode which is performed in such a case that (i) image forming jobs are performed in succession, and (ii) it is necessary to stop an image formation to be performed for the second image forming job and to cause the second image forming job to be in a stand-by state so that the time required to perform a post-process for the first image forming job followed by the second image forming job is secured, and (iii) the second image forming job is for a single-side image formation.

The stacked sheet discharge has the following modes: double-stacked sheet discharge and triple-stacked discharge. The double-stacked sheet discharge is performed such that (i) the first sheet and the second sheet each of which is for the second image forming job are overlapped with each other by using the third sheet-carrying path 36 and (ii) the two sheets thus overlapped are concurrently discharged. The triple-stacked sheet discharge is performed such that (i) the first sheet, the second sheet, and the third sheet (each of which is for the second image forming job) are overlapped with each other by using the third sheet-carrying path 36 and the fourth sheet-carrying path 39 and (ii) the three sheets thus overlapped are concurrently discharged.

With the double-stacked sheet discharge, it is possible to delay discharging the first sheet for the second image forming job to the post-processing device 3 for time taken for processing one sheet. This makes it possible to perform a post-process for the first image forming job by utilizing the delay time gained by the delay of the first sheet for the second image forming job.

That is, if time required to perform a post-process for the first image forming job is within the delay time gained by the delay of the first sheet for the second image forming job, it is possible to perform the second image forming job subsequently after the first image forming job, without stopping an image formation to be performed for the second image forming job. Further, even if the time required to perform the post-process for the first image forming job exceeds the delay time gained by the delay of the first sheet for the second image forming job, it is possible to reduce time in which the image formation to be performed for the second image forming job is stopped.

With the triple-stacked sheet discharge, it is possible to delay discharging the first sheet for the second image forming job to the post-processing device 3 for time taken for processing two sheets. This makes it possible to perform a post-process for the first image forming job by utilizing the delay time gained by the delay of the first sheet for the second image forming job.

Figure 2:
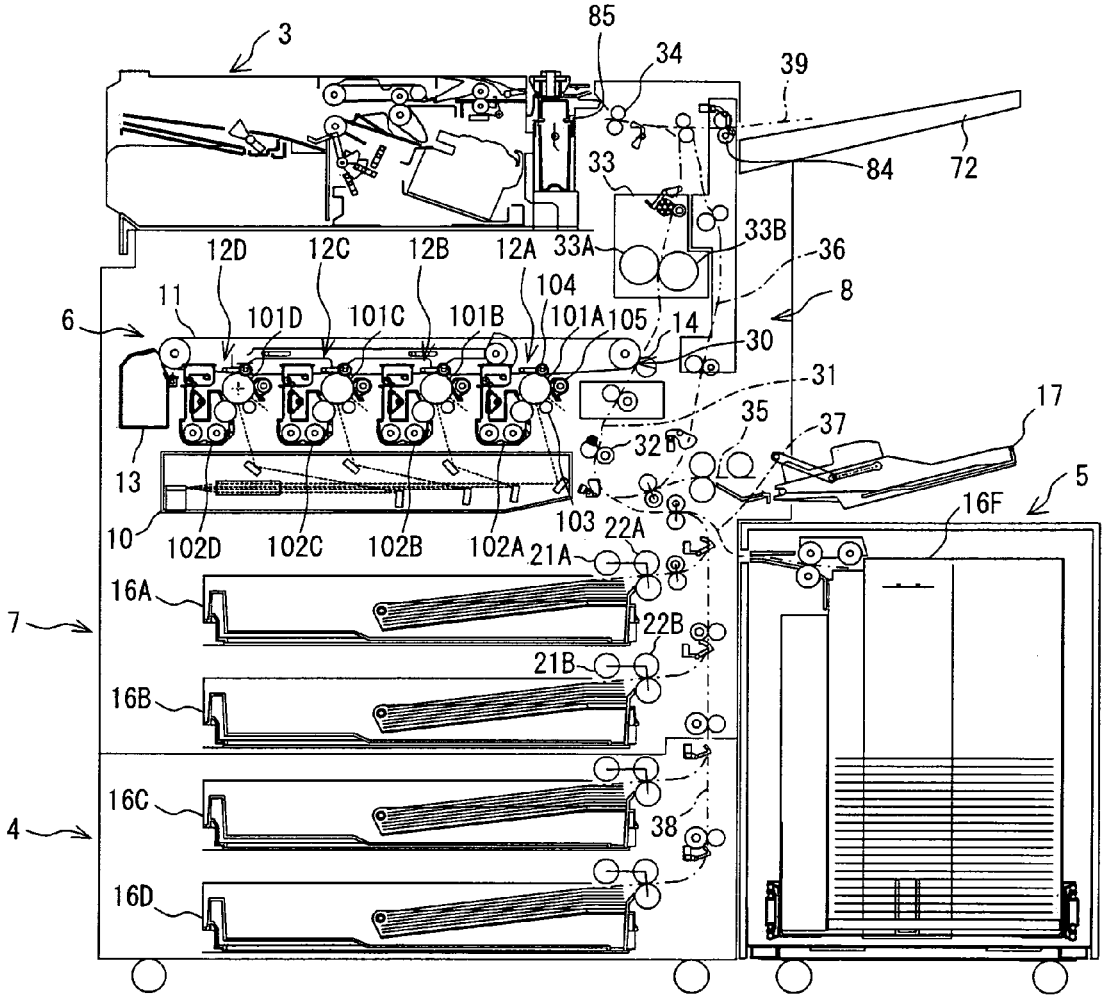
FIG. 2 is a view illustrating an arrangement of the image forming system.

FIG. 1 is a functional block diagram for performing the double-stacked sheet discharge and the triple-stacked sheet discharge. In order to perform the double-stacked sheet discharge and the triple-stacked sheet discharge, the followings are provided: a single-side image formation judgment section (single-side image formation judgment means) 91; a wait-time occurrence judgment section (wait-time occurrence judgment means) 92; a stacked sheet discharge control section (stacked sheet discharge control means) 93; and an image forming order adjustment section (image forming order adjustment means) 94. These sections are realized by the PCU 52 and the ICU 51.

The single-side image formation judgment section 91 judges whether or not an image forming job is for a single-side image formation. The wait-time occurrence judgment section 92 judges whether or not it is necessary to delay an image formation to be processed for the second image forming job so that time required to perform a post-process for the first image forming job is secured.

When the single-side image formation judgment section 91 judges that the second image forming job is for a single-side image formation and the wait-time occurrence judgment section 92 judges that wait-time is to be occurred, the stacked sheet discharge control section 93 controls a sheet carrying mechanism in the first sheet-carrying path 31, the third sheet-carrying path 36, and the fourth sheet-carrying path 39 so that the double-stacked sheet discharge or the triple-stacked sheet discharge is performed. That is, the stacked sheet discharge control section 93 controls: the first gate 75; the second gate 76; the first sheet-discharging roller 34; the second sheet-discharging roller 84; the first carrying roller 81; the second carrying roller 82; and the third carrying roller 83. In the present embodiment, however, it is not necessary to control the first gate 75.

A detection signal is inputted to the stacked sheet discharge control section 93 from the sheet feeding sensors 41, the first sheet-rear-end detecting sensor 61, the second sheet-rear-end detecting sensor 62, the third sheet-rear-end detecting sensor 63, and the like. In accordance with the detection signal thus inputted, the second gate 76, the first sheet-discharging roller 34, the second sheet-discharging roller 84, the fourth carrying roller 87, the first carrying roller 81, the second carrying roller 82, the third carrying roller 83 are controlled by the stacked sheet discharge control section 93 in a manner described later.

In a case that the double-stacked sheet discharge or the triple-stacked sheet discharge is performed, the image forming order adjustment section 94 adjusts order of formation of images. This adjustment is performed in accordance with stacking order of sheets which are concurrently and overlappedly discharged.

In the stacked sheet discharge, stacking of sheets does not always start from a sheet on which an image is formed first. In the double-stacked sheet discharge in the present embodiment, the second sheet which is carried after the first sheet is placed at the bottom. In the triple-stacked sheet discharge in the present embodiment, the third sheet which is carried after the first sheet and the second sheet is placed at the bottom, and then the first sheet and the second sheet are placed on the third sheet, in this order.

Therefore, the image forming order adjustment section 94 adjusts the order of formation of images so that sheets are overlapped with each other in order of page number when the sheets are discharged to the post-processing device 3. In a case of the double-stacked sheet discharge, the image forming order adjustment section 94 adjusts the order of formation of images so that (i) an image for the first page is printed on the second sheet and (ii) an image for the second page is printed on the first sheet. In a case of the triple-stacked sheet discharge, the image forming order adjustment section 94 adjusts the order of formation of images so that (i) an image for the first page is printed on the third sheet, (ii) an image for the second page is printed on the first sheet, and (iii) an image for the third page is printed on the second sheet.

It is possible to select and fix, in advance, a sheet discharge mode to be performed by the stacked sheet discharge control section 93, out of the double-stacked sheet discharge and the triple-stacked sheet discharge. However, the present embodiment may adopt such an arrangement that either of them is selected depending on the time required to perform a post-process.

Figure 8:
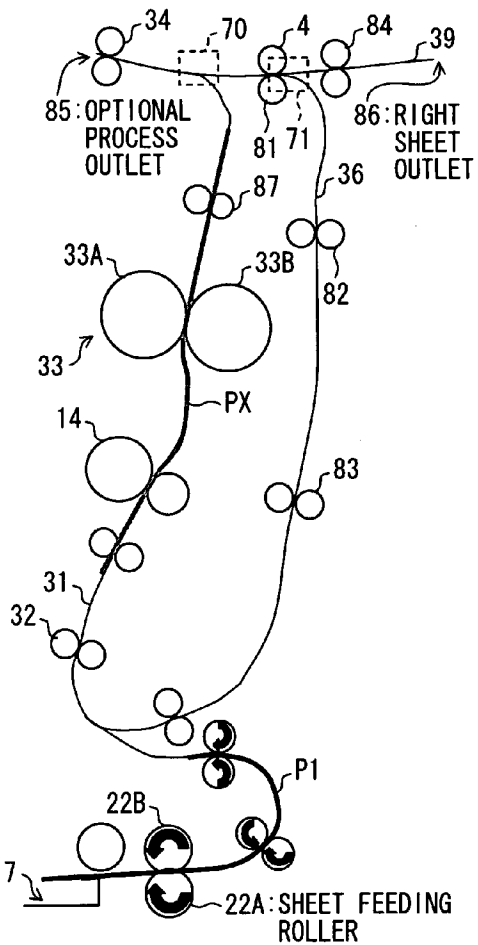
FIGS. 8(*a*) through 8(*c*) are explanatory views illustrating a flow of a sheet during double-stacked sheet discharge performed by the image forming system.
Figure 8:
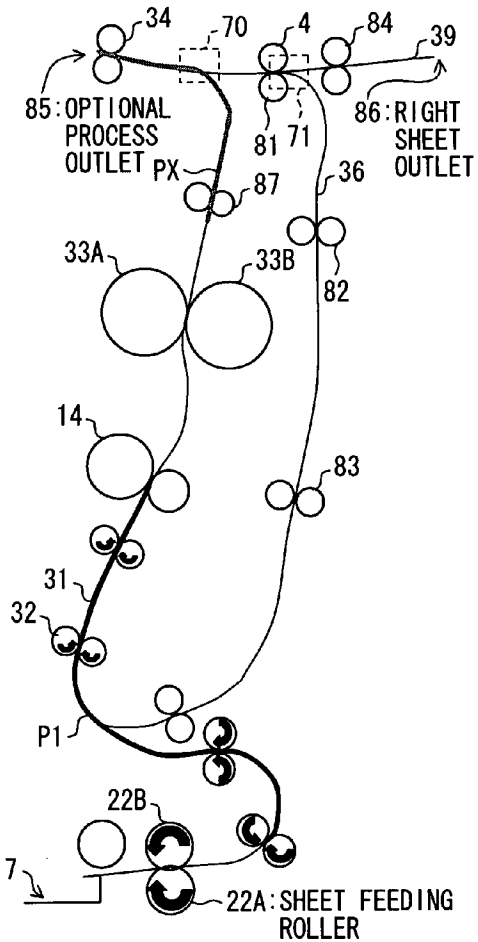
Figure 8:
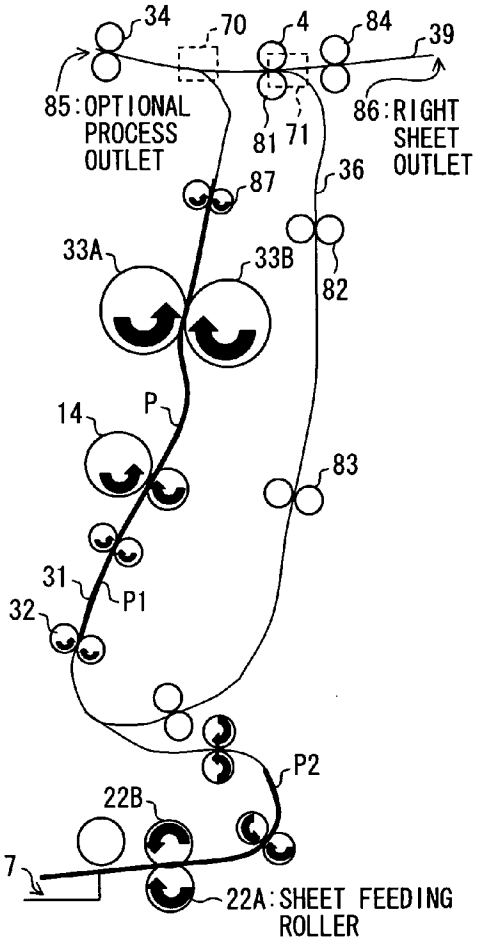

Firstly, the following describes the double-stacked sheet discharge. FIG. 8(*a*) through FIG. 8(*c*), FIG. 9(*a*) through FIG. 9(*c*), and FIG. 10(*a*) through FIG. 10(*c*) illustrate a flow of a sheet during the double-stacked sheet discharge.

As illustrated in FIG. 8(*a*) and FIG. 8(*b*), after a first sheet P1 is fed, the first sheet P1 is carried to the first sheet-carrying path 31. Then, as illustrated in FIG. 8(*c*), while the first sheet P1 passes through the second transfer roller 14 and the fixing unit 33, a second sheet P2 is fed. The second sheet P2 is carried to the first sheet-carrying path 31, while maintaining a sheet interval W to the first sheet P1. The sheet interval W may be the same as a sheet interval maintained while the image forming apparatus 2 is operating with its maximum performance (i.e., 100%).

Figure 9:
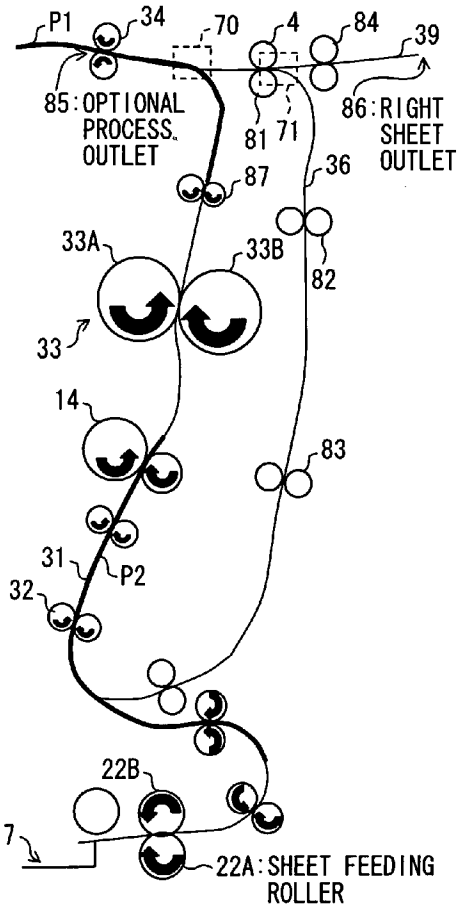
FIGS. 9(*a*) through 9(*c*) are explanatory views illustrating the flow of the sheet during the double-stacked sheet discharge performed by the image forming system, and illustrating the subsequent flow after the flow illustrated in FIGS. 8(*a*) to 8(*c*).
Figure 9:
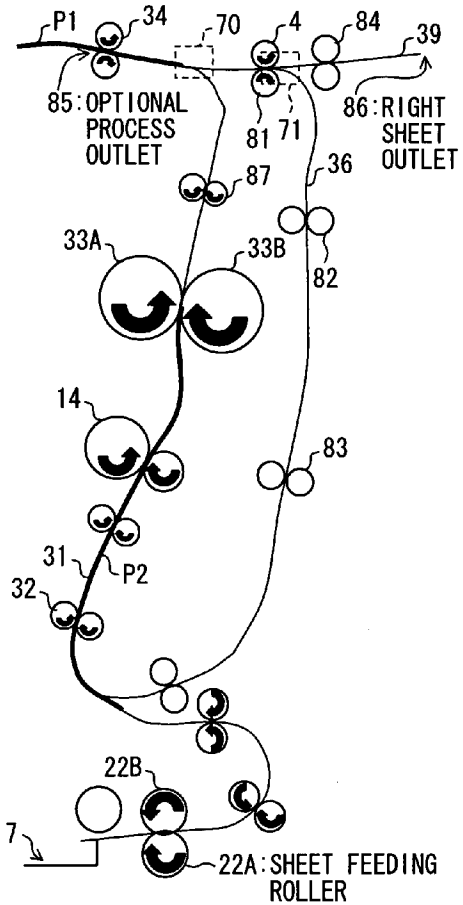
Figure 9:
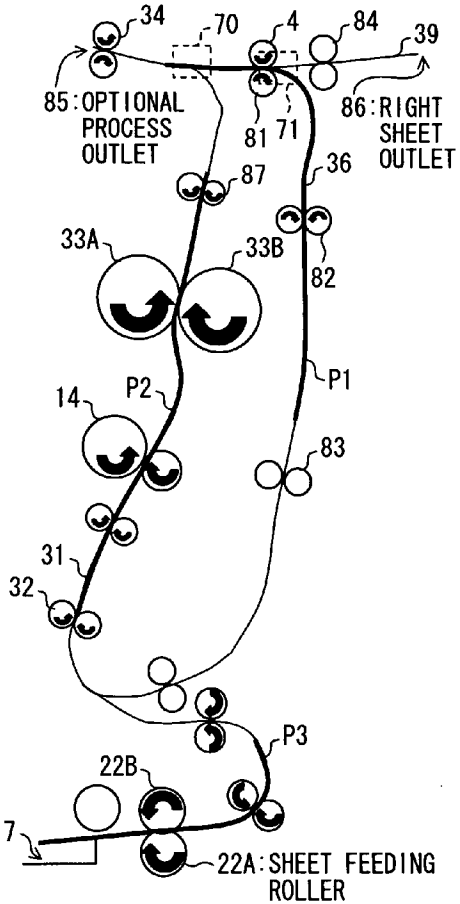

As illustrated in FIG. 9 (*a*), the first sheet P1 passes through the first diverging section 70 toward the optional process outlet 85. Then, a portion of the first sheet P1 passes through the optional process outlet 85 by means of the first sheet-discharging roller 34, so that the portion of the first sheet P1 reaches the post-processing device 3.

Subsequently, as illustrated in FIG. 9(*b*), when the rear end of the first sheet P1 passes through the first diverging section 70, the first sheet-discharging roller 34 is driven in the reverse direction. This causes the first sheet P1 to be carried in the switchback manner. As illustrated in FIG. 9(*c*), the first sheet P1 thus carried in the switchback manner passes through the second diverging section 71 toward the third sheet-carrying path 36. Then, the first sheet P1 is carried into the third sheet-carrying path 36 by means of the first carrying roller 81 and the second carrying roller 82. After that, as illustrated in FIG. 10(*a*), the first sheet P1 stops with its rear end held by the first carrying roller 81.

In the foregoing operation in which the first sheet P1 is carried into the third sheet-carrying path 36, the speed of the fourth carrying roller 87 and the first sheet-discharging roller 34 is increased at a point that the rear end of the first sheet P1 has passed through the fixing unit 33. This allows the first sheet P1 to be carried at a faster speed than a speed at which the second sheet P2 is carried. Similarly, the first carrying roller 81 and the second carrying roller 82, each of which is for further pulling a sheet whose top end is carried into the third sheet-carrying path 36, carry the first sheet P1 at an increased speed. This allows the first sheet P1 to be in a stand-by state in the third sheet-carrying path 36 before a top end of the second sheet P2 passes through the first diverging section 70.

Figure 10:
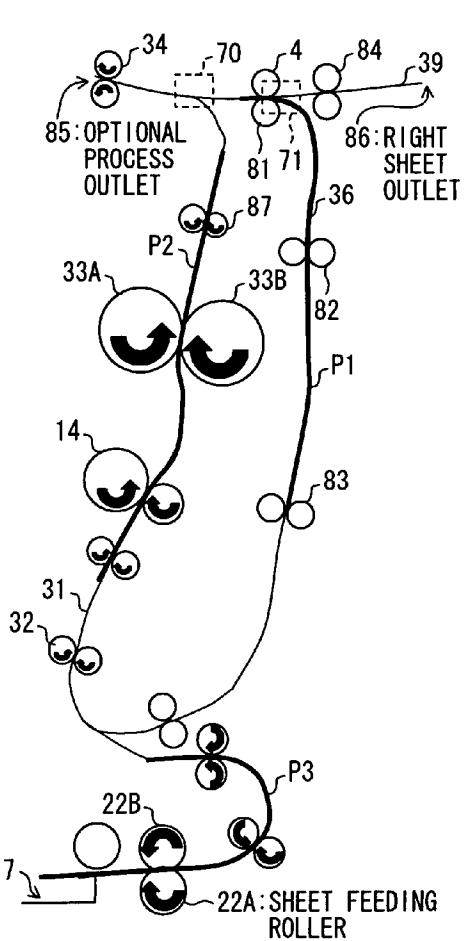
FIGS. 10(*a*) through 10(*c*) are explanatory views illustrating the flow of the sheet during the double-stacked sheet discharge performed by the image forming system, and illustrating the subsequent flow after the flow illustrated in FIGS. 9(*a*) to 9(*c*).
Figure 10:
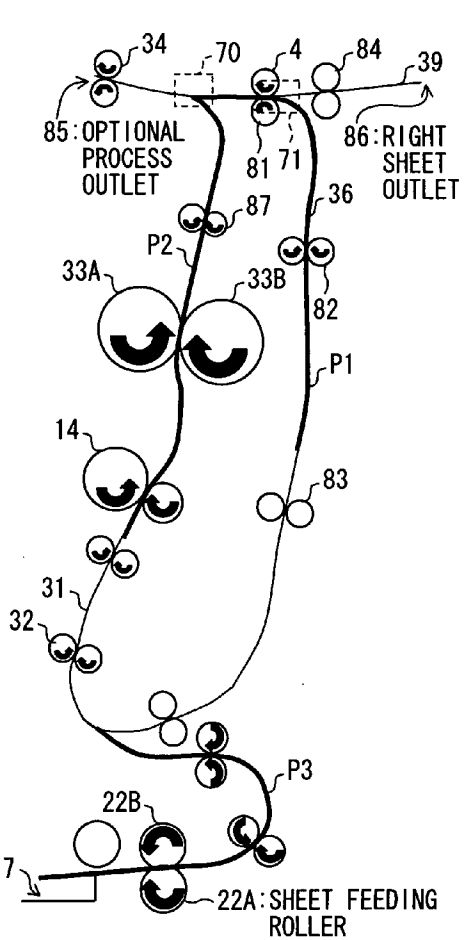
Figure 10:
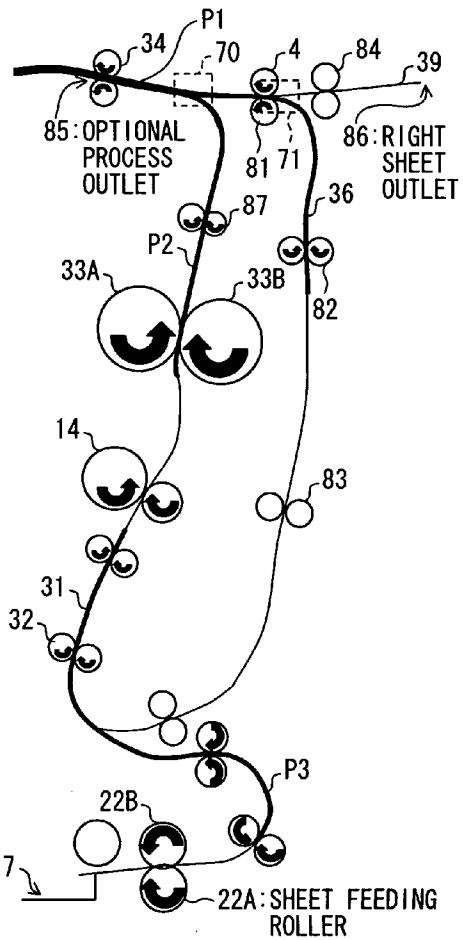

After that, as illustrated in FIG. 10(*b*), carrying of the first sheet P1 which is stopped starts at a timing that causes the top end of the first sheet P1 to reach the first diverging section 70 when the top end of the second sheet P2, carried toward the optional process outlet 85 through the first sheet-carrying path 31, reaches the first diverging path 70. Then, as illustrated in FIG. 10(*c*), the first sheet P1 and the second sheet P2 are carried to the optional process outlet 85, with the first sheet P1 placed on the second sheet P2 and the top ends of the two sheets aligned.

In the process as described above, the first carrying roller 81 and the second carrying roller 82, each of which causes the first sheet P1 to be carried in the switchback manner again toward the optional process outlet 85, start rotating again at a controlled timing so that the top ends of the first sheet P1 and the second sheet P2 are aligned.

As illustrated in FIG. 9(*c*), in a state where the first sheet P1 is carried into the third sheet-carrying path 36 and the second sheet P2 is passing through the fixing unit 33, the third sheet P3 by which the second sheet P2 is followed is already fed. The third sheet P3 is carried to the first sheet-carrying path 31 while also maintaining the sheet interval W to the second sheet P2. Further, after the first sheet P1 and the second sheet P2 which are overlapped with each other are carried, the third sheet P3 is subsequently carried, while the third sheet P3 maintains the sheet interval W to the first sheet P1 and the second sheet P2 which are overlapped. Then, after the first sheet P1 and the second sheet P2 which are overlapped with each other are discharged, the third sheet P3 is subsequently discharged. Carrying of a sheet after the third sheet P3 is performed in the same manner as in a conventional single-side image formation.

As such, a first sheet P1 and a second sheet P2 are overlapped with each other, and are discharged concurrently. With this, after a final sheet PX (see FIG. 8(*a*) and FIG. 8(*b*)) for the first image forming job followed by the second image forming job is discharged to the post-processing device 3, a timing for discharging, to the post-processing device 3, a sheet for the second image forming job is delayed for time taken for processing one sheet.

The time taken for forming an image on one sheet is utilized for performing a post-process for the first image forming job. Therefore, if time required to perform the post-process is within the delay time for which a timing for discharging a sheet is delayed and which is equal to the time taken for processing one sheet, it is possible to perform the second image forming job subsequently after the first image forming job, without stopping an image formation to be performed for the second image forming job. Further, even if the time required to perform the post-process exceeds the delay time for which the timing for discharging the sheet is delayed and which is equal to the time taken for processing one sheet, it is possible to reduce time in which the image formation to be performed for the second image forming job is stopped.

Figure 11:
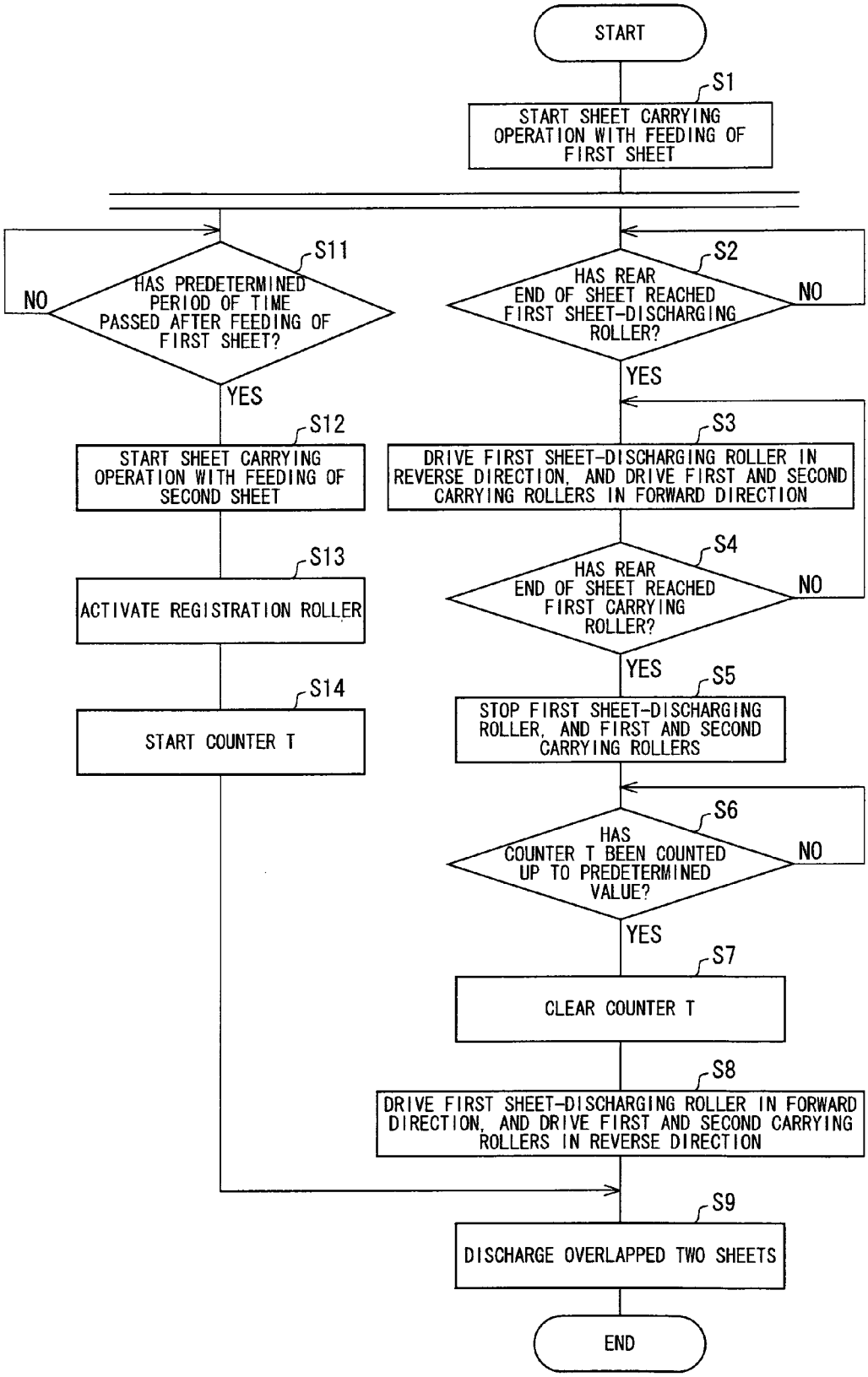
FIG. 11 illustrates a control flow of the double-stacked sheet discharge performed by the image forming system.

Next, the following describes how the stacked sheet discharge control section 93 controls the double-stacked sheet discharge. FIG. 11 is a control flow of the double-stacked sheet discharge performed by the stacked sheet discharge control section 93.

Carrying of a sheet starts when a first sheet P1 is fed (S1). When the carrying of the sheet is started with the feeding of the first sheet P1, two processes are performed in parallel. One of the two processes is for the first sheet P1 (from S2 to S8), and the other is for a second sheet P2 (from S11 to S14).

Firstly, the process for the first sheet P1 is described. In S2, it is judged whether or not a rear end of the first sheet P1 has reached the first sheet-discharging roller 34 (i.e., whether or not the first sheet-rear-end detecting sensor 61 detects the rear end of the sheet). If it is judged that the rear end of the first sheet P1 has reached the first sheet-discharging roller 34, the first sheet-discharging roller 34 is driven in the reverse direction, and the first carrying roller 81 and the second carrying roller 82 are driven in the forward direction (S3).

Subsequently, in S4, it is judged whether or not the rear end of the first sheet P1 has reached the first carrying roller 81 (whether or not the second sheet-rear-end detecting sensor 62 detects the rear end of the sheet). If it is judged that the rear end of the first sheet P1 has reached the first carrying roller 81, the first sheet-discharging roller 34, the first carrying roller 81, and the second carrying roller 82 are stopped (S5). Then, the first sheet P1 stands by until a counter T is counted up to a predetermined value (S6).

The counter T is for determining a timing at which the carrying of the first sheet P1 is restarted. The timing at which the carrying of the first sheet P1 is restarted is determined so that a top end of the first sheet P1, which is carried again, is aligned with a top end of the second sheet P2, which is carried through the first sheet-carrying path 31.

When the counter T is counted up to the predetermined value, the counter T is cleared (S7). Then, the first sheet-discharging roller 34 is driven in the forward direction, and the first carrying roller 81 and the second carrying roller 82 are driven in the reverse direction (S8).

On the other hand, in S11, it is judged whether or not a predetermined period of time has passed after the feeding of the first sheet P1. If it is judged that the predetermined period of time has passed, the second sheet P2 is fed and the carrying of the sheet is started (S12). The predetermined period of time is needed for ensuring the sheet interval W, which is necessary between the first sheet P1 and the second sheet P2.

As well as the second sheet P2, any sheet is instantly stopped at a point when the sheet reaches the registration roller 32, for the purpose of alignment of the sheet with an image. In the present embodiment, restart of rotation (i.e., activation) of the registration roller 32 is used as a trigger for setting a timing for restarting the carrying of the first sheet P1. Therefore, in the carrying of the second sheet P2, when the registration roller 32 is activated (S13), the counter T is started (S14).

As a result of the control described above, the first sheet P1, which is once carried into the third sheet-carrying path 36 and then is returned to the first sheet-carrying path 31 when the counter T is counted up to the predetermined value, is placed on the second sheet P2, which is carried through the first sheet-carrying path 31. Then, the first sheet P1 and the second sheet P2 thus overlapped are concurrently discharged to the post-processing device 3, with the top ends of the first sheet P1 and the second sheet P2 aligned (S9).

Figure 12:
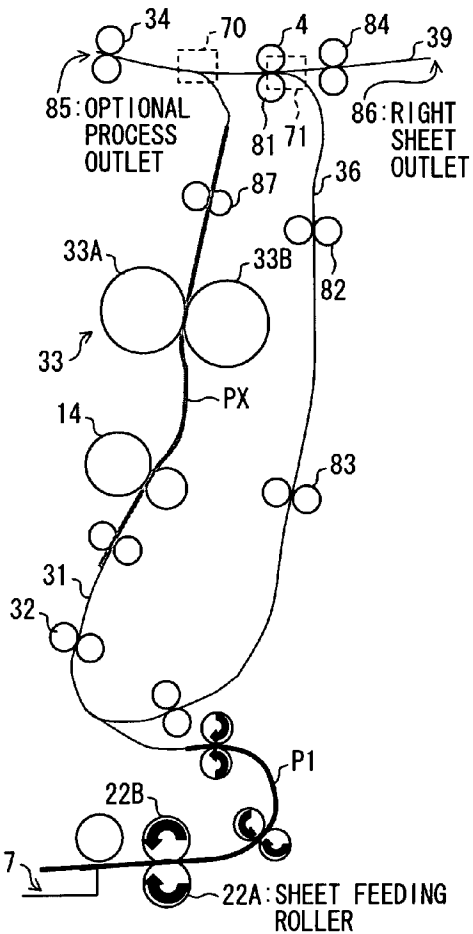
FIGS. 12(*a*) through 12(*c*) are explanatory views illustrating a flow of a sheet during triple-stacked sheet discharge performed by the image forming system.
Figure 12:
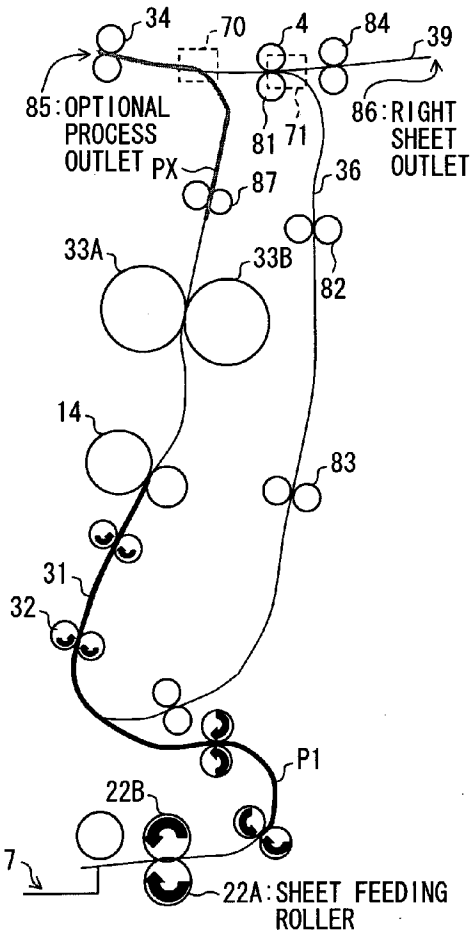
Figure 12:
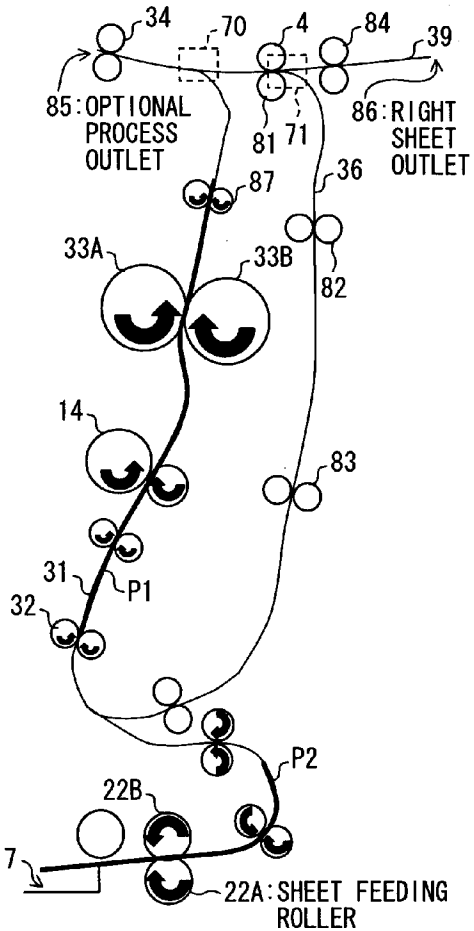

Next, the following describes the triple-stacked sheet discharge. FIG. 12(*a*) through FIG. 12(*c*), FIG. 13(*a*) through FIG. 13(*c*), FIGS. 14(*a*) through FIG. 14(*c*), and FIG. 15(*a*) through FIG. 15(*c*) illustrate a flow of a sheet during the triple-stacked sheet discharge.

As illustrated in FIG. 12(*a*) and FIG. 12(*b*), after a first sheet P1 is fed, the first sheet P1 is carried to the first sheet-carrying path 31. Then, as illustrated in FIG. 12(*c*), while the first sheet P1 is passing through the second transfer roller 14 and the fixing unit 33, a second sheet P2 is fed. The second sheet P2 is carried to the first sheet-carrying path 31, while maintaining a sheet interval W to the first sheet P1. The sheet interval W may be the same as a sheet interval maintained while the image forming apparatus 2 is operating with its maximum performance (i.e., 100%).

Figure 13:
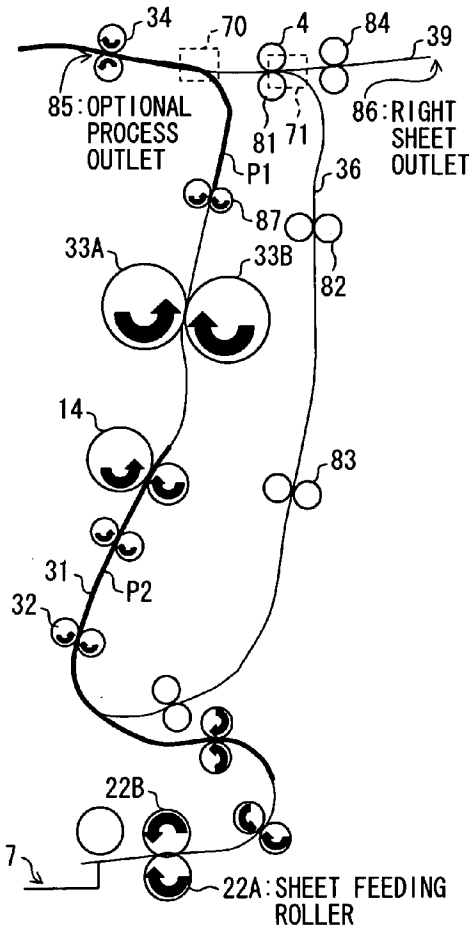
FIGS. 13(*a*) through 13(*c*) are explanatory views illustrating the flow of the sheet during the triple-stacked sheet discharge performed by the image forming system, and illustrating the subsequent flow after the flow illustrated in FIGS. 12(*a*) to 12(*c*).
Figure 13:
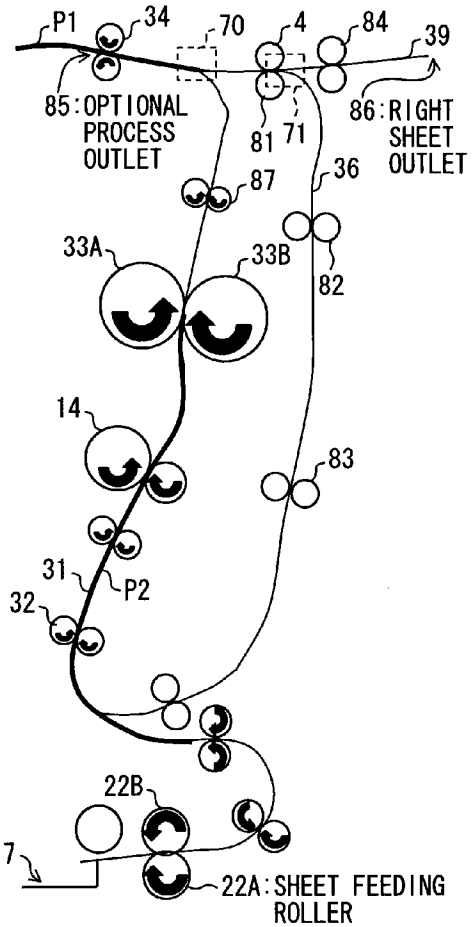
Figure 13:
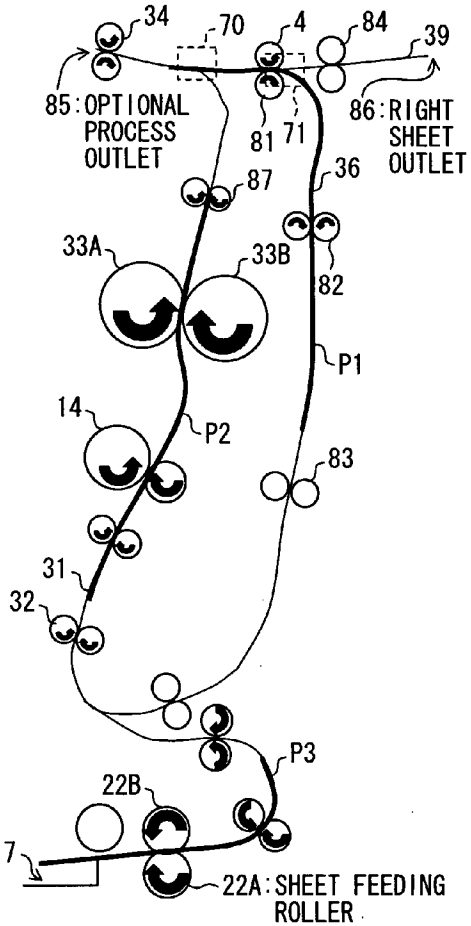

As illustrated in FIG. 13(*a*), the first sheet P1 passes through the first diverging section 70 toward the optional process outlet 85. Then, a portion of the first sheet P1 passes through the optional process outlet 85 by means of the first sheet-discharging roller 34, so that the portion of the first sheet P1 reaches the post-processing device 3.

Subsequently, as illustrated in FIG. 13(*b*), when a rear end of the first sheet P1 passes though the first diverging section 70, the first sheet-discharging roller 34 is driven in the reverse direction. This causes the first sheet P1 to be carried in the switchback manner. As illustrated in FIG. 13(*c*), the first sheet P1 thus carried in the switchback manner passes through the second diverging section 71 toward the third sheet-carrying path 36. Then, the first sheet P1 is carried into the third sheet-carrying path 36 by means of the first carrying roller 81, the second carrying roller 82, and the third carrying roller 83.

In the foregoing operation in which the first sheet P1 is carried into the third sheet-carrying path 36, the speed of the fourth carrying roller 87 and the first sheet-discharging roller 34 is increased at a point that the rear end of the first sheet P1 has passed through the fixing unit 33. This allows the first sheet P1 to be carried at a faster speed than a speed at which the second sheet P2 is carried. Similarly, the first carrying roller 81, the second carrying roller 82, and the third carrying roller 83 carry the first sheet P1 at an increased speed.

Figure 14:
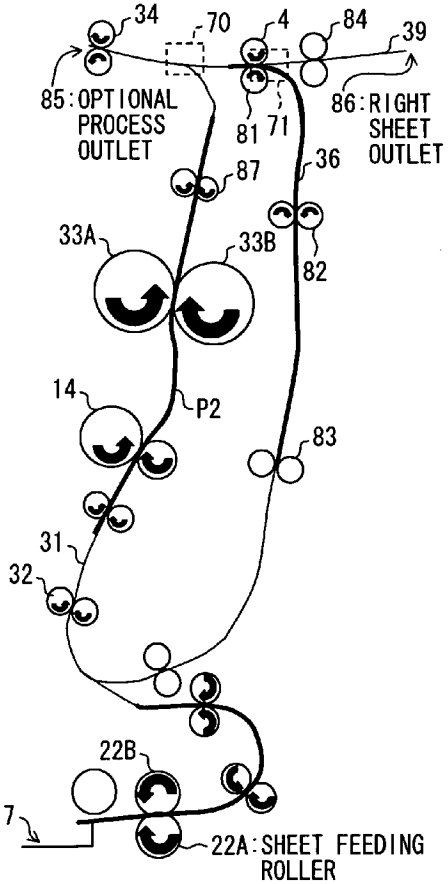
FIGS. 14(*a*) through 14(*c*) are explanatory views illustrating the flow of the sheet during the triple-stacked sheet discharge performed by the image forming system, and illustrating the subsequent flow after the flow illustrated in FIGS. 13(*a*) to 13(*c*).
Figure 14:
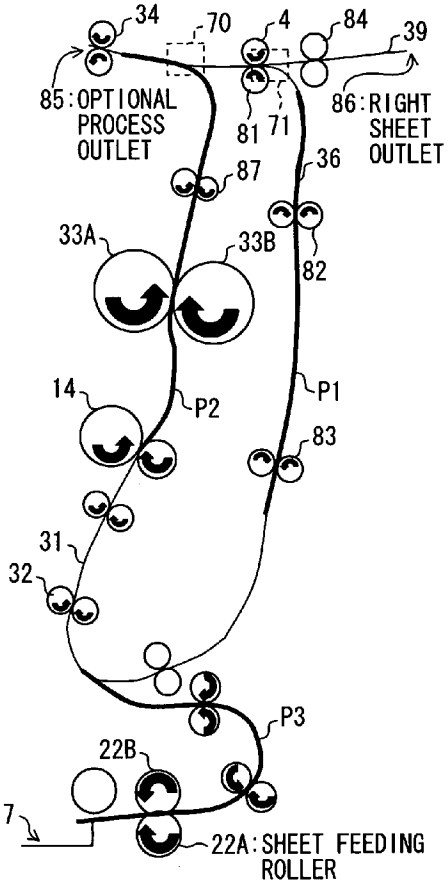
Figure 14:
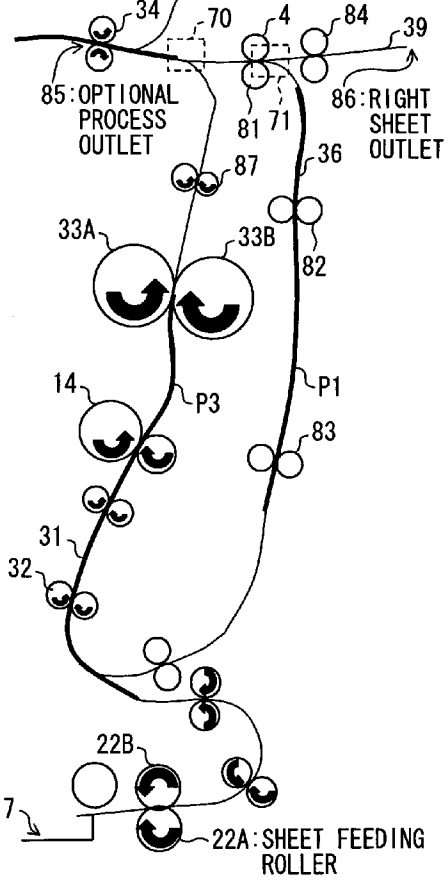

After the first sheet P1 is thus carried into the third sheet-carrying path 36, the first sheet P1 is stopped in a state, as illustrated in FIG. 14(*b*), where the rear end of the first sheet P1 has passed through the first carrying roller 81. In this state, the first sheet P1 is further pulled into the third sheet-carrying path 36, compared with a state illustrated in FIG. 14(*a*) where the rear end of the first sheet P1 is held by the first carrying roller 81.

On the other hand, at this time, the second sheet P2 passes through the first diverging section 70 toward the optional process outlet 85. Then, a portion of the second sheet P2 passes through the optional process outlet 85 by means of the first sheet-discharging roller 34, so that the portion of the second sheet P2 reaches the post-processing device 3.

Then, as illustrated in FIG. 14(*c*), when a rear end of the second sheet P2 passes through the first diverging section 70, the first sheet-discharging roller 34 is driven in the reverse direction. This causes the second sheet P2 to be carried in the switchback manner.

Figure 15:
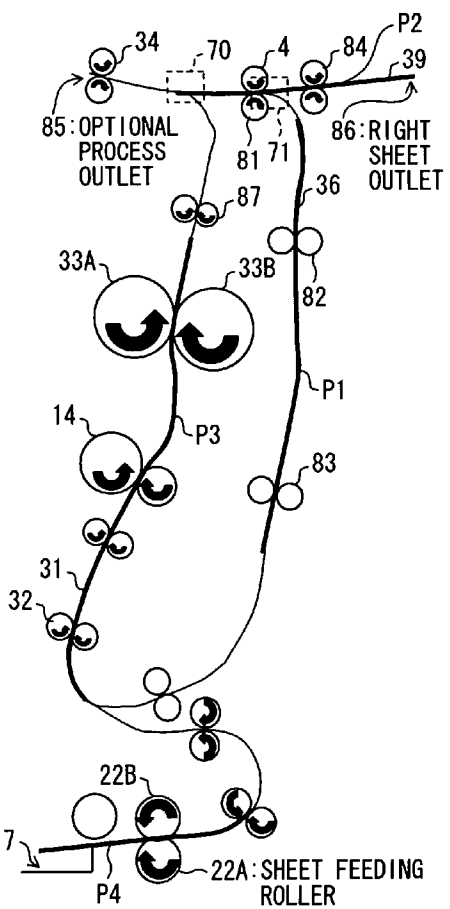
FIGS. 15(*a*) through 15(*c*) are explanatory views illustrating the flow of the sheet during the triple-stacked sheet discharge performed by the image forming system, and illustrating the subsequent flow after the flow illustrated in FIGS. 14(*a*) to 14(*c*).
Figure 15:
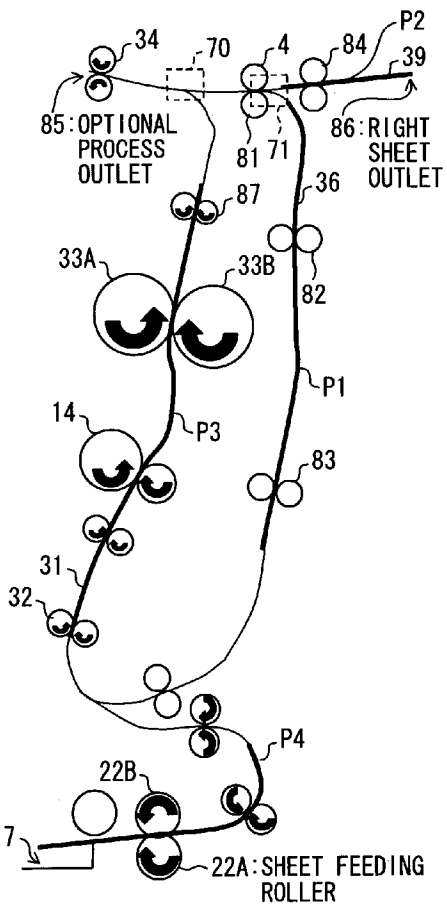
Figure 15:
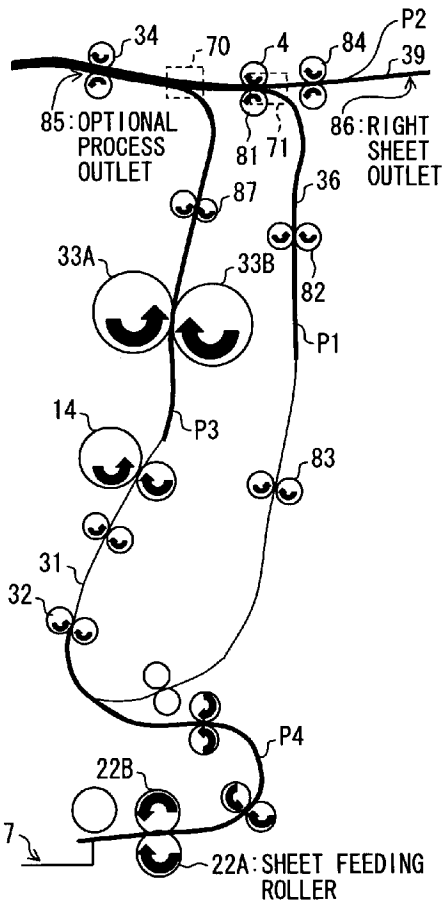

As illustrated in FIG. 15(*a*), the second sheet P2 thus carried in the switchback manner passes through the second diverging section 71 toward the right sheet outlet 86. Then, the second sheet P2 is carried to the right sheet outlet 86 by means of the first carrying roller 81 and the second sheet-discharging roller 84. After that, as illustrated in FIG. 15(*b*), the second sheet P2 is stopped with its rear end held by the second sheet-discharging roller 84.

Subsequently, carrying of the first sheet P1 and the second sheet P2, each of which is stopped, starts at a timing that causes the top ends of the first sheet P1 and the second sheet P2 to reach the first diverging section 70 when a top end of a third sheet P3, carried toward the optional process outlet 85 through the first sheet-carrying path 31, reaches the first diverging section 70. Thus, as illustrated in FIG. 15(*c*), the first sheet P1, the second sheet P2, and the third sheet P3 which are overlapped with each other are carried to the optional process outlet 85, with the top ends of the three sheets aligned.

In the process as described above, the second carrying roller 82 and the third carrying roller 83, each of which causes the first sheet P1 to be carried in the switchback manner again toward the optional process outlet 85, start rotating again at a controlled timing so that the top ends of the first sheet P1 and the third sheet P3 are aligned.

Similarly, the second sheet-discharging roller 84, which causes the second sheet P2 to be carried in the switchback manner again toward the optional process outlet 85, starts rotating again at a controlled timing so that the top ends of the second sheet P2 and the third sheet P3 are aligned.

The image forming system 1 is provided with the shared path 42 shared by the third sheet-carrying path 36 and the fourth sheet-carrying path 39. In the shared path 42, it is possible to overlap the first sheet P1 and the second sheet P2 each other in advance while the first sheet P1 and the second sheet P2 are in the stand-by state. This makes it possible to align the top ends of the three sheets more easily, compared with a method in which three sheets carried from the three directions, respectively, are overlapped with each other at once.

As illustrated in FIG. 15(*b*), in a state that (i) the first sheet P1 is carried into the third sheet-carrying path 36 and is caused to be in the stand-by state, (ii) the second sheet P2 is carried to the right sheet output tray 72 through the fourth sheet-carrying path 39 and is caused to be in the stand-by state, and (iii) the third sheet P3 passes through the fixing unit 33, a fourth sheet P4 to be subsequently processed is already fed. The fourth sheet P4 is carried toward the first sheet-carrying path 31, while maintaining the sheet interval W to the third sheet P3.

The fourth sheet P4 is carried subsequently after the three sheets (the first sheet P1, the second sheet P2, and the third sheet P3) which are overlapped with each other are carried, while the fourth sheet P4 maintains the sheet interval W to the three sheets thus overlapped. Then, after the three sheets which are overlapped with each other are discharged, the fourth sheet P4 is subsequently discharged. Carrying of a sheet after the fourth sheet P4 is performed in the same manner as in a conventional single-side image formation.

As such, a first sheet P1, a second sheet P2, and a third sheet P3 are overlapped with each other, and are discharged concurrently. With this, after a final sheet PX (see FIG. 12(*a*) and FIG. 12(*b*)) for the first image forming job is discharged to the post-processing device 3, a timing for discharging, to the post-processing device 3, a sheet for the second image forming job is delayed for time taken for forming an image on two sheets. The time taken for forming an image on two sheets can be utilized for performing a post-process for the first image forming job.

As described above, the time taken for forming an image on two sheets is utilized for performing a post-process for the first image forming job. Therefore, if time required to perform the post-process is within the delay time for which a timing for discharging a sheet is delayed and which is equal to the time for forming images on two sheets, it is possible to perform the second image forming job subsequently after the first image forming job, without stopping an image formation to be performed for the second image forming job. Further, even if the time required to perform the post-process exceeds the delay time for which the timing for discharging the sheet is delayed and which is equal to the time for forming images on two sheets, it is possible to reduce time in which the image formation to be performed for the second image forming job is stopped.

Figure 16:
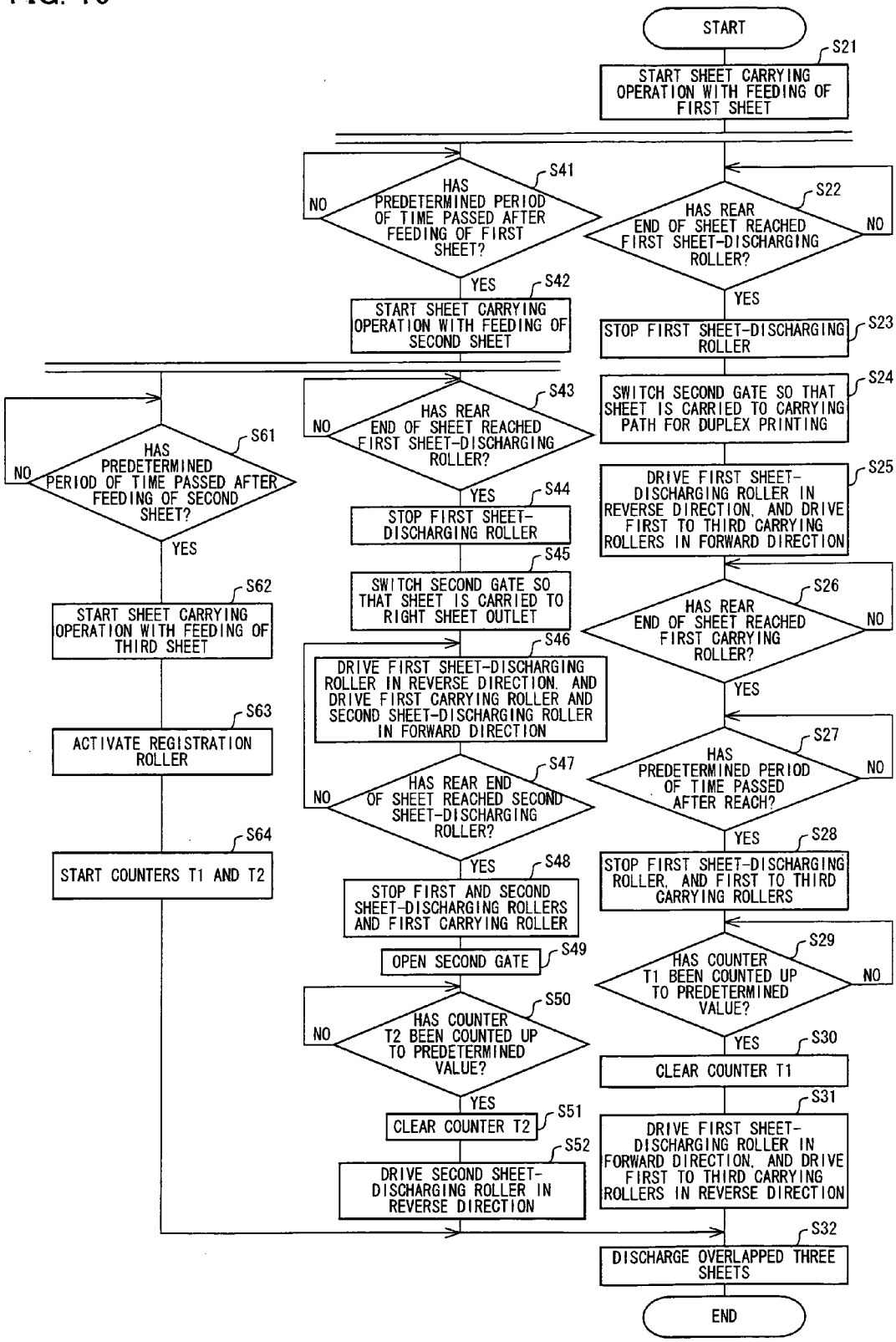
FIG. 16 is a control flow of the triple-stacked sheet discharge performed by the image forming system.

Next, the following describes how the stacked sheet discharge control section 93 controls the triple-stacked sheet discharge. FIG. 16 is a control flow of the triple-stacked sheet discharge performed by the stacked sheet discharge control section 93.

Carrying of a sheet starts when a first sheet P1 is fed (S21). When the carrying of the sheet is started with the feeding of the first sheet P1, two processes are performed in parallel. One of the two processes is for the first sheet P1 (from S22 to S31), and the other is for a second sheet P2 (from S41 to S52).

Firstly, the process for the first sheet P1 is described. In S22, it is judged whether or not a rear end of the first sheet P1 has reached the first sheet-discharging roller 34 (i.e., whether or not the first sheet-rear-end detecting sensor 61 detects the rear end of the sheet). If it is judged that the rear end of the first sheet P1 has reached the first sheet-discharging roller 34, the first sheet-discharging roller 34 is stopped (S23). Then, the second gate 76 is switched so that the sheet is carried to the third sheet-carrying path 36 (carrying path for duplex printing) (S24). After that, the first sheet-discharging roller 34 is driven in the reverse direction, and the first carrying roller 81, the second carrying roller 82, and the third carrying roller 83 are driven in the forward direction (S25).

Subsequently, in S26, it is judged whether or not the rear end of the first sheet P1 has reached the first carrying roller 81 (i.e., whether or not the second sheet-rear-end detecting sensor 62 detects the rear end of the sheet). If it is judged that the rear end of the first sheet P1 has reached the first carrying roller 81, judgment whether or not a predetermined period of time has passed after the reaching of the rear end of the first sheet P1 is subsequently made (S27). The predetermined period of time is for completely pulling the rear end of the first sheet P1 out of the first carrying roller 81. The distance between the first carrying roller 81 and a rear end of a sheet is controlled by using the predetermined time of time.

If it is judged that the predetermined period of time has passed, the first sheet-discharging roller 34, the first carrying roller 81, the second carrying roller 82, and the third carrying roller 83 are stopped (S28). Then, the first sheet P1 stands by until a counter T1 is counted up to a predetermined value (S29).

The counter T1 is for determining a timing at which the carrying of the first sheet P1 is restarted. The timing at which the carrying of the first sheet P1 is restarted is determined so that a top end of the first sheet P1, which is carried again, is aligned with a top end of a third sheet P3, which is carried through the first sheet-carrying path 31.

When the counter T1 is counted up to the predetermined value, the counter T1 is cleared (S30). Then, the first sheet-discharging roller 34 is driven in the forward direction, and the first carrying roller 81, the second carrying roller 82, and the third carrying roller 83 are driven in the reverse direction (S31).

On the other hand, in S41, it is judged whether or not a predetermined period of time has passed after the feeding of the first sheet P1. If it is judged that the predetermined period of time has passed, the second sheet P2 is fed and the carrying of the sheet is restarted (S42). The predetermined period of time is needed for ensuring the sheet interval W, which is necessary between the first sheet P1 and the second sheet P2.

When the carrying of the sheet is started with the feeding of the second sheet P2, two processes are performed in parallel. One of the two processes is for the second sheet P2 (from S43 to S52), and the other is for the third sheet P3 (from S61 to S64).

Firstly, the process for the second sheet P2 is described. In S43, it is judged whether or not a rear end of the second sheet P2 has reached the first sheet-discharging roller 34 (i.e., whether or not the first sheet-rear-end detecting sensor 61 detects the rear end of the sheet). If it is judged that the rear end of the second sheet P2 has reached the first sheet-discharging roller 34, the first sheet-discharging roller 34 is stopped (S44). Then, the second gate 76 is switched so that the sheet is carried to the fourth sheet-carrying path 39 (right sheet outlet) (S45). After that, the first sheet-discharging roller 34 is driven in the reverse direction, and the first carrying roller 81 and the second sheet-discharging roller 84 are driven in the forward direction (S46).

Subsequently, in S47, it is judged whether or not the rear end of the second sheet P2 has reached the second sheet-discharging roller 84 (i.e., whether or not the third sheet-rear-end detecting sensor 63 detects the rear end of the sheet) (S47). If it is judged that the rear end of the second sheet P2 has reached the second sheet-discharging roller 84, the first sheet-discharging roller 34, the second sheet-discharging roller 84, and the first carrying roller 81 are stopped (S48). Then, the second gate 76 is opened so that the sheet is carried either from the third sheet-carrying path 36 (carrying path for duplex printing) or the fourth sheet-carrying path 39 (right sheet outlet) (S49). Then, the second sheet P2 stands by until a counter T2 is counted up to a predetermined value (S50).

The counter T2 is for determining a timing at which the carrying of the second sheet P2 is restarted. The timing at which the carrying of the second sheet P2 is restarted is determined so that a top end of the second sheet P2, which is carried again, is aligned with the top end of the third sheet P3, which is carried through the first sheet-carrying path 31.

When the counter T2 is counted up to the predetermined value, the counter T2 is cleared (S51). Then, the second sheet-discharging roller 84 is driven in the reverse direction (S52).

Next, the following describes the process for the third sheet P3. In S61, it is judged whether or not a predetermined period of time has passed after the feeding of the second sheet P2. If it is judged that the predetermined period of time has passed, the third sheet P3 is fed and the carrying of the sheet is started (S62). The predetermined period of time is needed for ensuring the sheet interval W, which is necessary between the second sheet P2 and the third sheet P3.

As well as the third sheet P3, any sheet is instantly stopped at a point when the sheet reaches the registration roller 32, for the purpose of alignment of the sheet with an image. In the present embodiment, restart of rotation (i.e., activation) of the registration roller 32 is used as a trigger for setting a timing for restarting the carrying of the first sheet P1 and the second sheet P2. Therefore, in the carrying of the third sheet P3, when the registration roller 32 is activated (S63), the counter T1 and the counter T2 are restarted (S64).

As a result of the control described above, (i) the first sheet P1, which is once carried into the third sheet-carrying path 36 and then is returned to the first sheet-carrying path 31 when the counter T1 is counted up to the predetermined value, (ii) the second sheet P2, which is in a stand-by state in the fourth sheet-carrying path 39, and (iii) the third sheet P3, which is carried through the first sheet-carrying path 31, are overlapped with each other in order of the third sheet P3, the first sheet P1, and the second sheet P2, from the bottom. Then, the three sheets thus overlapped are discharged to the post-processing device 36, with the top ends of the three sheets aligned (S32).

The triple-stacked sheet discharge may have such an arrangement that: the first sheet P1 is caused to be in a stand-by state in the fourth sheet-carrying path 39; and the second sheet P2 is caused to be in a stand-by state in the third sheet-carrying path 36.

The image forming system according to the present embodiment is arranged so that the control section 50 of the image forming apparatus 2 includes: the single-side image formation judgment section (single-side image formation judgment means) 91; the wait-time occurrence judgment section (wait-time occurrence judgment means) 92; the stacked sheet discharge control section (stacked sheet discharge control means) 93; and the image forming order adjustment section (image forming order adjustment means) 94. However, the image forming system may also be arranged so that the control section 60 of the post-processing device 3 includes these sections (means).

Lastly, the single-side image formation judgment section (single-side image formation judgment means) 91, the wait-time occurrence judgment section (wait-time occurrence judgment means) 92, the stacked sheet discharge control section (stacked sheet discharge control means) 93, and the image forming order adjustment section (image forming order adjustment means) 94, each of which is included in the image forming system 1, may be realized by way of hardware or software as executed by a CPU as follows.

The image forming system 1 includes a CPU (central processing unit) and memory devices (memory media). The CPU executes instructions in control programs realizing the functions. The memory devices include a ROM (read only memory) which contains the programs, a RAM (random access memory) to which the programs are loaded, and a memory containing the programs and various data. The object of the present invention can also be achieved by mounting, to the image forming system 1, a computer-readable storage medium containing control program code (executable program, intermediate code program, or source program) for the image forming system 1, which is software realizing the aforementioned functions, in order for the computer (or CPU, MPU) to retrieve and execute the program code contained in the storage medium.

The storage medium may be, for example, a tape, such as a magnetic tape or a cassette tape; a magnetic disk, such as a floppy (Registered Trademark) disk or a hard disk, or an optical disk, such as CD-ROM/MO/MD/DVD/CD-R; a card, such as an IC card (memory card) or an optical card; or a semiconductor memory, such as a mask ROM/EPROM/EEPROM/flash ROM.

The image forming system 1 may be arranged to be connectable to a communications network so that the program code may be delivered over the communications network. The communications network is not limited in any particular manner, and may be, for example, the Internet, an intranet, extranet, LAN, ISDN, VAN, CATV communications network, virtual dedicated network (virtual private network), telephone line network, mobile communications network, or satellite communications network. The transfer medium which makes up the communications network is not limited in any particular manner, and may be, for example, wired line, such as IEEE 1394, USB, electric power line, cable TV line, telephone line, or ADSL line; or wireless, such as infrared radiation (IrDA, remote control), Bluetooth (Registered Trademark), 802.11 wireless, HDR, mobile telephone network, satellite line, or terrestrial digital network. The present invention encompasses a carrier wave or data signal transmission in which the program code is embodied electronically.

The present invention is not limited to the description of the embodiments above, but may be altered by a skilled person within the scope of the claims. An embodiment based on a proper combination of technical means disclosed in different embodiments is encompassed in the technical scope of the present invention.

As described above, a first image forming apparatus according to the present invention includes: (A) a sheet feeding section in which a sheet is stored; (B) an image forming section for forming an image on the sheet; (C) a first discharging section for discharging, to outside of the apparatus, the sheet on which the image is formed; (D) a main carrying path for directing the sheet from the sheet feeding section to the first discharging section through the image forming section; and (E) a first sub-carrying path for directing the sheet on which one side an image is formed, from an upstream side of the first discharging section in the main carrying path to an upstream side of the image forming section, (i) said image forming apparatus and (ii) a post-processing device, to be added to the image forming apparatus, for performing a post-process with respect to a sheet discharged from the first discharging section, constituting an image forming system, said image forming apparatus, further including: (F) a wait-time occurrence judgment section for judging whether or not it is necessary to delay an image formation to be processed for a second image forming job so that time required to perform a post-process for a first image forming job followed by the second image forming job is secured; (G) a single-side image formation judgment section for judging whether or not the second image forming job is for a single-side image formation in which an image is formed only on one side of a sheet; and (H) a stacked sheet discharge control section for controlling, when the wait-time occurrence judgment section judges it to be necessary to delay the image formation and the single-side image formation judgment section judges the second image forming job to be for the single-side image formation, a sheet carrying mechanism in the main carrying path and the first sub-carrying path so that (i) a first sheet for the second image forming job which first sheet is fed to the first discharging section through the main carrying path is directed from the first discharging section to the first sub-carrying path so as to be in a stand-by state, and (ii) the first sheet which is in the stand-by state and a second sheet for the second image forming job which second sheet is fed to the first discharging section through the main carrying path are concurrently and overlappedly discharged.

According to this, the wait-time occurrence judgment section judges whether or not it is necessary to delay the image formation to be processed for the second image forming job so that the time required to perform the post-process for the first image forming job followed by the second image forming job is secured. Further, the single-side image formation judgment section judges whether or not the second image forming job is for the single-side image formation in which the image is formed only on one side of the sheet.

Then, when the wait-time occurrence judgment section judges it to be necessary to delay the image formation and the single-side image formation judgment section judges the second image forming job to be for the single-side image formation, the stacked sheet discharge control section controls the sheet carrying mechanism in the main carrying path and the first sub-carrying path so that (i) the first sheet for the second image forming job which first sheet is fed to the first discharging section through the main carrying path is directed from the first discharging section to the first sub-carrying path so as to be in the stand-by state, and (ii) the first sheet which is in the stand-by state and the second sheet for the second image forming job which second sheet is fed to the first discharging section through the main carrying path are concurrently and overlappedly discharged.

Discharging the two sheets concurrently delays, for time taken for processing one sheet, a timing for discharging, to the post-processing device, the first sheet for the second image forming job. Therefore, it is possible to perform the post-process for the first image forming job by utilizing the delay time equal to the time taken for processing one sheet.

That is, if time required to perform the post-process for the first image forming job is within the delay time for which the timing for discharging the sheet is delayed and which is equal to the time taken for processing one sheet, it is possible to perform the second image forming job subsequently after the first image forming job, without stopping the image formation to be performed for the second image forming job. Further, even if the time required to perform the post-process for the first image forming job exceeds the delay time for which the timing for discharging the sheet is delayed and which is equal to the time taken for processing one sheet, it is possible to reduce time in which the image formation to be performed for the second image forming job is stopped.

Thus, constituting an image forming system by using an image forming apparatus according to the present invention makes it possible to realize an image forming system which has a high productivity and does not reduce performance of an image forming apparatus wastefully.

A second image forming apparatus according to the present invention includes: (A) a sheet feeding section in which a sheet is stored; (B) an image forming section for forming an image on the sheet; (C) a first discharging section for discharging, to outside of the apparatus, the sheet on which the image is formed; (D) a main carrying path for directing the sheet from the sheet feeding section to the first discharging section through the image forming section; (E) a first sub-carrying path for directing the sheet on which one side an image is formed, from an upstream side of the first discharging section in the main carrying path to an upstream side of the image forming section; and (F) a second sub-carrying path for directing the sheet from the upstream side of the first discharging section in the main carrying path to a second discharging section, (i) said image forming apparatus and (ii) a post-processing device, to be added to the image forming apparatus, for performing a post-process with respect to a sheet discharged from the first discharging section, constituting an image forming system, said image forming apparatus, further including: (G) a wait-time occurrence judgment section for judging whether or not it is necessary to delay an image formation to be processed for a second image forming job so that time required to perform a post-process for a first image forming job followed by the second image forming job is secured; (H) a single-side image formation judgment section for judging whether or not the second image forming job is for a single-side image formation in which an image is formed only on one side of a sheet; and (I) a stacked sheet discharge control section for controlling, when the wait-time occurrence judgment section judges it to be necessary to delay the image formation and the single-side image formation judgment section judges the second image forming job to be for the single-side image formation, a sheet carrying mechanism in the main carrying path, the first sub-carrying path, and the second sub-carrying path so that (i) a first sheet for the second image forming job which first sheet is fed to the first discharging section through the main carrying path is directed from the first discharging section to one of the first and second sub-carrying paths so as to be in a stand-by state, (ii) a second sheet for the second image forming job which second sheet is fed to the first discharging section through the main carrying path is directed from the first discharging section to the other of the first and second sub-carrying paths so as to be in a stand-by state, and (iii) the first sheet and the second sheet which are in the stand-by state and a third sheet for the second image forming job which third sheet is fed to the first discharging section through the main carrying path are concurrently and overlappedly discharged.

According to this, the wait-time occurrence judgment section judges whether or not it is necessary to delay the image formation to be processed for the second image forming job so that the time required to perform the post-process for the first image forming job followed by the second image forming job is secured. Further, the single-side image formation judgment section judges whether or not the second image forming job is for the single-side image formation in which the image is formed only on one side of the sheet.

Then, when the wait-time occurrence judgment section judges it to be necessary to delay the image formation and the single-side image formation judgment section judges the second image forming job to be for the single-side image formation, the stacked sheet discharge control section functions so that (i) the first sheet for the second image forming job which first sheet is fed to the first discharging section through the main carrying path is directed from the first discharging section to one of the first and second sub-carrying paths so as to be in the stand-by state, (ii) the second sheet for the second image forming job which second sheet is fed to the first discharging section through the main carrying path is directed from the first discharging section to the other of the first and second sub-carrying paths so as to be in the stand-by state, and (iii) the first sheet and the second sheet which are in the stand-by state and the third sheet for the second image forming job which third sheet is fed to the first discharging section through the main carrying path are concurrently and overlappedly discharged.

Discharging the three sheets concurrently delays, for time taken for processing two sheets, a timing for discharging the first sheet for the second image forming job to the post-processing device. Therefore, it is possible to perform the post-process for the first image forming job by utilizing the delay time equal to the time taken for processing two sheets.

That is, if time required to perform the post-process for the first image forming job is within the delay time for which the timing for discharging the sheet is delayed and which is equal to the time taken for processing two sheets, it is possible to perform the second image forming job subsequently after the first image forming job, without stopping the image formation to be performed for the second image forming job. Further, even if the time required to perform the post-process for the first image forming job exceeds the delay time for which the timing for discharging the sheet is delayed and which is equal to the time taken for processing two sheets, it is possible to reduce time in which the image formation to be performed for the second image forming job is stopped.

Thus, constituting an image forming system by using an image forming apparatus according to the present invention makes it possible to realize an image forming system which has a high productivity and does not reduce performance of an image forming apparatus wastefully.

In such an arrangement that two sheets are caused to be in a stand-by state in the first sub-carrying path and the second sub-carrying path, respectively, it is particularly preferable that a part of the first sub-carrying path is shared with the second sub-carrying path, the part being on the upstream side of the first discharging section.

Sharing, at the upstream side of the first discharging section, a part of the first sub-carrying path with the second sub-carrying path allows the two sheets in the stand-by state to be overlapped with each other in the shared part in advance. This makes it possible to align the top ends of the three sheets more easily, compared with a method in which three sheets carried from the three directions, respectively, are overlapped with each other at once.

Further, it is preferable for the image forming apparatus according to the present invention to include an image forming order adjustment section for adjusting order of formation of images in accordance with stacking order of a plurality of sheets which are concurrently and overlappedly discharged.

In a case where a plurality of sheets are discharged overlappedly, arranging the main carrying path, the first sub-carrying path, and the second carrying path so that the sheets are stacked in the same order as in a case where the sheets are discharged one by one and stacked in order of image formation decreases flexibility in designing. In view of this, in the foregoing arrangement of the present invention, the image forming order adjustment section adjusts the order of formation of images in accordance with the stacking order of the plurality of sheets which are concurrently and overlappedly discharged.

According to this, even in a case where the first sheet is placed on the second sheet and the two sheets are discharged with their printed sides facing down, it is possible to discharge the sheets in order of page number, as well as in a case where sheets are discharged one by one and stacked in order of image formation. This is realized by adjusting the order of formation of images so that: an image for the second page is formed on the first sheet; and an image for the first page is formed on the second sheet.

A first image forming system according to the present invention includes: (A) an image forming apparatus including: a sheet feeding section in which a sheet is stored; an image forming section for forming an image on the sheet; a first discharging section for discharging, to outside of the apparatus, the sheet on which the image is formed; a main carrying path for directing the sheet from the sheet feeding section to the first discharging section through the image forming section; and a first sub-carrying path for directing the sheet on which one side an image is formed, from an upstream side of the first discharging section in the main carrying path to an upstream side of the image forming section; and (B) a post-processing device for performing a post-process on a sheet discharged from the first discharging section, said image forming system, further including: (C) a wait-time occurrence judgment section for judging whether or not it is necessary to delay an image formation to be processed for a second image forming job so that time required to perform a post-process for a first image forming job followed by the second image forming job is secured; (D) a single-side image formation judgment section for judging whether or not the second image forming job is for a single-side image formation in which an image is formed only on one side of a sheet; and (E) a stacked sheet discharge control section for controlling, when the wait-time occurrence judgment section judges it to be necessary to delay the image formation and the single-side image formation judgment section judges the second image forming job to be for the single-side image formation, a sheet carrying mechanism in the main carrying path and the first sub-carrying path so that (i) a first sheet for the second image forming job which first sheet is fed to the first discharging section through the main carrying path is directed from the first discharging section to the first sub-carrying path so as to be in a stand-by state, and (ii) the first sheet which is in the stand-by state and a second sheet for the second image forming job which second sheet is fed to the first discharging section through the main carrying path are concurrently and overlappedly discharged.

As in the description regarding the image forming apparatus, this realizes an image forming system which has a high productivity and does not reduce performance of an image forming apparatus wastefully.

A second image forming system according to the present invention includes: (A) an image forming apparatus including: a sheet feeding section in which a sheet is stored; an image forming section for forming an image on the sheet; a first discharging section for discharging, to outside of the apparatus, the sheet on which the image is formed; a main carrying path for directing the sheet from the sheet feeding section to the first discharging section through the image forming section; a first sub-carrying path for directing the sheet on which one side an image is formed, from an upstream side of the first discharging section in the main carrying path to an upstream side of the image forming section; and a second sub-carrying path for directing the sheet from the upstream side of the first discharging section in the main carrying path to a second discharging section; and (B) a post-processing device for performing a post-process on a sheet discharged from the first discharging section, said image forming system, further including: (C) a wait-time occurrence judgment section for judging whether or not it is necessary to delay an image formation to be processed for a second image forming job so that time required to perform a post-process for a first image forming job followed by the second image forming job is secured; (D) a single-side image formation judgment section for judging whether or not the second image forming job is for a single-side image formation in which an image is formed only on one side of a sheet; and (E) a stacked sheet discharge control section for controlling, when the wait-time occurrence judgment section judges it to be necessary to delay the image formation and the single-side image formation judgment section judges the second image forming job to be for the single-side image formation, a sheet carrying mechanism in the main carrying path, the first sub-carrying path, and the second sub-carrying path so that (i) a first sheet for the second image forming job which first sheet is fed to the first discharging section through the main carrying path is directed from the first discharging section to one of the first and second sub-carrying paths so as to be in a stand-by state, (ii) a second sheet for the second image forming job which second sheet is fed to the first discharging section through the main carrying path is directed from the first discharging section to the other of the first and second sub-carrying paths so as to be in a stand-by state, and (iii) the first sheet and the second sheet which are in the stand-by state and a third sheet for the second image forming job which third sheet is fed to the first discharging section through the main carrying path are concurrently and overlappedly discharged.

As in the description regarding the image forming apparatus, this realizes an image forming system which has a high productivity and does not reduce performance of an image forming apparatus wastefully.

Further, a third image forming apparatus according to the present invention includes: (A) a sheet feeding section in which a sheet is stored; (B) an image forming section for forming an image on the sheet; (C) a first discharging section for discharging, to outside of the apparatus, the sheet on which the image is formed; (D) a main carrying path for directing the sheet from the sheet feeding section to the first discharging section through the image forming section; and (E) a first sub-carrying path for directing the sheet on which one side an image is formed, from an upstream side of the first discharging section in the main carrying path to an upstream side of the image forming section, (i) said image forming apparatus and (ii) a post-processing device, to be added to the image forming apparatus, for performing a post-process with respect to a sheet discharged from the first discharging section, constituting an image forming system, said image forming apparatus, further including: (F) a stacked sheet discharge control section for controlling a sheet carrying mechanism in the main carrying path and the first sub-carrying path so that (i) a first sheet which is fed to the first discharging section through the main carrying path is directed from the first discharging section to the first sub-carrying path so as to be in a stand-by state, and (ii) the first sheet which is in the stand-by state and a second sheet which is fed to the first discharging section through the main carrying path subsequently after the first sheet are concurrently and overlappedly discharged.

According to this, the stacked sheet discharge control section controls the sheet carrying mechanism in the main carrying path and the first sub-carrying path so that (i) the first sheet which is fed to the first discharging section through the main carrying path is directed from the first discharging section to the first sub-carrying path so as to be in the stand-by state, and (ii) the first sheet which is in the stand-by state and the second sheet which is fed to the first discharging section through the main carrying path subsequently after the first sheet are concurrently and overlappedly discharged.

As described above, in a case where it is necessary to delay the image formation to be processed for the second image forming job so that time required to perform the post-process for the first image forming job is secured, the two-sheet simultaneous discharge as described above is applied to the first sheet and the second sheet for the second image forming job so that the first sheet and the second sheet are overlapped with each other and discharged concurrently. This makes it possible to provide an image forming system which improves its productivity and does not reduce performance of an image forming apparatus wastefully. In the image forming system, it is not necessary to delay an image formation to be processed for the second image forming job, or even if the delay is inevitable, this can reduce the delay time as much as possible.

A fourth image forming apparatus according to the present invention includes: (A) a sheet feeding section in which a sheet is stored; (B) an image forming section for forming an image on the sheet; (C) a first discharging section for discharging, to outside of the apparatus, the sheet on which the image is formed; (D) a main carrying path for directing the sheet from the sheet feeding section to the first discharging section through the image forming section; (E) a first sub-carrying path for directing the sheet on which one side an image is formed, from an upstream side of the first discharging section in the main carrying path to an upstream side of the image forming section; and (F) a second sub-carrying path for directing the sheet from the upstream side of the first discharging section in the main carrying path to a second discharging section which is not the first discharging section, (i) said image forming apparatus and (ii) a post-processing device, to be added to the image forming apparatus, for performing a post-process with respect to a sheet discharged from the first discharging section, constituting an image forming system, said image forming apparatus, further including: (G) a stacked sheet discharge control section for controlling a sheet carrying mechanism in the main carrying path, the first sub-carrying path, and the second sub-carrying path so that (i) a first sheet which is fed to the first discharging section through the main carrying path is directed from the first discharging section to one of the first and second sub-carrying paths so as to be in a stand-by state, (ii) a second sheet which is fed to the first discharging section through the main carrying path subsequently after the first sheet is directed from the first discharging section to the other of the first and second sub-carrying paths so as to be in a stand-by state, and (iii) the first sheet and the second sheet which are in the stand-by state and a third sheet which is fed to the first discharging section through the main carrying path subsequently after the second sheet are concurrently and overlappedly discharged.

According to this, the stacked sheet discharge control section controls the sheet carrying mechanism in the main carrying path, the first sub-carrying path, and the second sub-carrying path so that (i) the first sheet which is fed to the first discharging section through the main carrying path is directed from the first discharging section to one of the first and second sub-carrying paths so as to be in the stand-by state, (ii) the second sheet which is fed to the first discharging section through the main carrying path subsequently after the first sheet is directed from the first discharging section to the other of the first and second sub-carrying paths so as to be in the stand-by state, and (iii) the first sheet and the second sheet which are in the stand-by state and the third sheet which is fed to the first discharging section through the main carrying path subsequently after the second sheet are concurrently and overlappedly discharged.

That is, as described above, in a case where it is necessary to delay the image formation to be processed for the second image forming job so that time required to perform the post-process for the first image forming job is secured, the three-sheet simultaneous discharge as described above is applied to the first to third sheets for the second image forming job so that the first to third sheets are overlapped with each other and discharged concurrently. This makes it possible to provide an image forming system which improves its productivity and does not reduce performance of an image forming apparatus wastefully. In the image forming system, it is not necessary to delay an image formation to be processed for the second image forming job, or even if the delay is inevitable, this can reduce the delay time as much as possible.

Further, the present invention encompasses a program for causing a computer to function as the wait-time occurrence judgment section, the single-side image formation judgment section, the stacked sheet discharge control section, and the image forming order adjustment section each of which is of the image forming apparatus according to the present invention. Furthermore, the present invention encompasses a computer-readable storage medium storing the program.

That is, the wait-time occurrence judgment section, the single-side image formation judgment section, the stacked sheet discharge control section, and the image forming order adjustment section each of which is of the image forming apparatus may be realized by way of hardware or a program executed by a computer. Specifically, the program according to the present invention is a program for causing a computer to function as each section described above, and the storage medium according to the present invention stores the program.

When the program is executed by a computer, the computer operates as the wait-time occurrence judgment section, the single-side image formation judgment section, the stacked sheet discharge control section, and the image forming order adjustment section each of which is of the image forming apparatus. That is, the program achieves the same effects as the wait-time occurrence judgment section, the single-side image formation judgment section, the stacked sheet discharge control section, and the image forming order adjustment section each of which is of the image forming apparatus.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus, comprising:

(A) a sheet feeding section in which a sheet is stored;

(B) an image forming section for forming an image on the sheet;

(C) a first discharging section for discharging, to outside the apparatus, the sheet on which the image is formed;

(D) a main carrying path for directing the sheet from the sheet feeding section to the first discharging section through the image forming section;

(E) a first sub-carrying path for directing the sheet on which one side an image is formed, from an upstream side of the first discharging section in the main carrying path to an upstream side of the image forming section; and (F) a second sub-carrying path for directing the sheet from the upstream side of the first discharging section in the main carrying path to a second discharging section, said image forming apparatus and a post-processing device constituting an image forming system, the post-processing device being attachable to the image forming apparatus and performing a post-process with respect to a sheet discharged from the first discharging section, said image forming apparatus, further comprising:

(G) a wait-time occurrence judgment section for judging whether or not it is necessary to delay an image formation to be processed for a second image forming job so that time required to perform a post-process for a first image forming job followed by the second image forming job is secured;

(H) a single-side image formation judgment section for judging whether or not the second image forming job is for a single-side image formation in which an image is formed only on one side of a sheet; and (I) a stacked sheet discharge control section for controlling, when the wait-time occurrence judgment section judges it to be necessary to delay the image formation and the single-side image formation judgment section judges the second image forming job to be for the single-side image formation, a sheet carrying mechanism in the main carrying path, the first sub-carrying path, and the second sub-carrying path so that (i) a first sheet for the second image forming job which first sheet is fed to the first discharging section through the main carrying path is carried in a switchback manner to be directed from the first discharging section to one of the first and second sub-carrying paths so as to be in a stand-by state, (ii) a second sheet for the second image forming job which second sheet is fed to the first discharging section through the main carrying path is carried in a switchback manner to be directed from the first discharging section to the other of the first and second sub-carrying paths so as to be in a stand-by state, and (iii) the first sheet and the second sheet which are in the stand-by state are again carried in a switchback manner so that the first sheet, the second sheet and a third sheet for the second image forming job which third sheet is fed to the first discharging section through the main carrying path and is not in a stand-by state are concurrently and overlappingly discharged.

2. The image forming apparatus as set forth in claim 1, wherein:

a part of the first sub-carrying path is shared with a part of the second sub-carrying path, the part being on the upstream side of the first discharging section.

3. The image forming apparatus as set forth in claim 1, further comprising:

an image forming order adjustment section for adjusting order of formation of images in accordance with stacking order of a plurality of sheets which are concurrently and overlappingly discharged.

* * * * *